US008971761B2

(12) United States Patent
Yuasa

(10) Patent No.: US 8,971,761 B2
(45) Date of Patent: Mar. 3, 2015

(54) IMAGE FORMING APPARATUS

(75) Inventor: Takao Yuasa, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 117 days.

(21) Appl. No.: 13/545,419

(22) Filed: Jul. 10, 2012

(65) Prior Publication Data

US 2013/0016996 A1 Jan. 17, 2013

(30) Foreign Application Priority Data

Jul. 11, 2011 (JP) ..... 2011-152830

(51) Int. Cl.

*G03G 15/08* (2006.01)
*G03G 15/01* (2006.01)
*G03G 15/16* (2006.01)

(52) U.S. Cl.

CPC ..... *G03G 15/0189* (2013.01); *G03G 15/161* (2013.01); *G03G 15/1615* (2013.01); *G03G 2215/00156* (2013.01); *G03G 2215/00168* (2013.01); *G03G 2215/1661* (2013.01)
USPC ..... 399/121; 399/66; 399/71; 399/148; 399/297

(58) Field of Classification Search

CPC ..... G03G 15/161; G03G 2215/00139; G03G 2215/00143; G03G 221/00168; G03G 2221/1642
USPC ..... 399/66, 71, 121, 148, 297
See application file for complete search history.

(56) References Cited

U.S. PATENT DOCUMENTS

| | | | | |
|---|---|---|---|---|
| 5,659,851 | A | 8/1997 | Moe et al. | |
| 6,305,282 | B1 * | 10/2001 | Datwyler | 101/169 |
| 2001/0028817 | A1 * | 10/2001 | Tamura et al. | 399/297 |
| 2010/0310286 | A1 * | 12/2010 | Yasumoto | 399/302 |

FOREIGN PATENT DOCUMENTS

| | | | |
|---|---|---|---|
| JP | 06194917 | A * | 7/1994 |
| JP | 2000-034031 | A | 2/2000 |
| JP | 2001-146335 | A | 5/2001 |
| JP | 2001-520611 | A | 10/2001 |
| JP | 2005-181651 | A | 7/2005 |
| JP | 2010-019899 | A | 1/2010 |
| JP | 2011-095315 | A | 5/2011 |
| JP | 2011197414 | A * | 10/2011 |

OTHER PUBLICATIONS

English Translation to JP 2011197414 A, Nukui, Oct. 6, 2011.*

* cited by examiner

*Primary Examiner* — Ryan Walsh
(74) *Attorney, Agent, or Firm* — Fitzpatrick, Cella, Harper & Scinto

(57) ABSTRACT

An image forming apparatus includes an inclining device for inclining the endless belt so as to keep the an endless belt in a normal range in a widthwise direction of the belt; a blade member for pressing against the belt at a pressing portion to clean it; a detecting portion for detecting deviation of the belt from a normal range in a widthwise direction thereof; and an executing portion for executing an operation in a mode in which a lubricant is supplied to the pressing portion, when the detecting portion detects that the belt is deviated from the normal range.

8 Claims, 17 Drawing Sheets

(a)

(b)

(a)

(b)

IMAGE FORMING APPARATUS

FIELD OF THE INVENTION AND RELATED ART

The present invention relates to an electrophotographic image forming apparatus such as an electrophotographic copying machine, an electrophotographic printer, etc., which is equipped with an intermediary transfer belt, a recording medium conveyance belt, or the like.

An image forming apparatus which forms a toner image, transfers the toner image onto recording medium, and fixes the toner image to the recording medium by applying heat and pressure with the use of a fixing device is widely in use. Such an image forming apparatus uses an intermediary transfer belt or a recording medium conveyance belt, that is, a member in the form of an endless belt. The intermediary transfer belt is an endless belt onto which a toner image is temporarily transferred before it is transferred onto recording medium. The recording medium conveyance belt is an endless belt for conveying a sheet of recording medium onto which a toner image is transferred. This member in the form of an endless belt tends to shift in the direction perpendicular to its moving direction. Thus, some image forming apparatuses which employ an intermediary transfer belt, a recording medium conveyance belt, or the like are equipped with a mechanism for steering the belt.

The image forming apparatus disclosed in Japanese Laid-open Patent Application 2000-34031 is provided with a belt steering roller and a motor for tilting the belt steering roller. It is structured so that the belt steering roller is rotationally movable about one of its lengthwise ends. If its member in the form of an endless belt laterally shifts, the steering roller is tilted by the belt tilting motor so that the other end of the belt steering roller moves upward or downward in order to create such a force that makes the belt to shift in the opposite direction.

Japanese Laid-open Patent Application 2001-146335 discloses an image forming apparatus which has a belt steering member, which is rotationally movable about its center in terms of the direction parallel to the direction in which the belt shifts. In the case of this image forming apparatus, as the belt laterally shifts, a force for causing the belt to shifts in the opposite direction from the direction in which the belt shifted is generated by tilting the belt steering member by rotationally moving the belt steering roller about its center in terms of the lengthwise direction of the belt steering roller.

There are various countermeasures for the problem that an endless belt tends to laterally shift as it is circularly moved. Proposed in Japanese Laid-open Patent Application 2001-520611 is one of these countermeasures. This countermeasure is significantly smaller in component count, simpler, and lower in cost than the others. It employs also a belt steering roller, and automatically aligns (centers) the belt by utilizing the imbalance between the friction between the belt and one of the lengthwise end portions of the belt steering belt and the belt, and the friction between the belt and the other lengthwise end portions of the belt steering roller (this belt aligning method hereafter may be referred to as "automatic belt alignment").

More concretely, each of the lengthwise end portions of the belt steering roller is provided with a friction generating portion. Thus, as the belt laterally shifts, the friction between one end of the belt steering roller and the belt becomes greater than that between the other end of the belt steering roller and the belt. Thus, the difference in the amount of friction between one end of the belt steering roller and the other end is utilized to obtain the torque to rotationally moving the belt steering roller about its center in terms of its lengthwise direction.

However, it was discovered that an automatic belt aligning method such as the described above suffers from the following problem. That is, a cleaning blade is placed in contact with the outward surface (in terms of loop which endless belt forms) of the endless belt supported by the belt steering member. Thus, if the belt is not supplied with toner for a substantial length of time, it is possible that the belt will laterally shift as it is circularly moved.

SUMMARY OF THE INVENTION

According to the present invention, it is possible to prevent the problem that the toner shortage on the intermediary transfer belt, recording medium conveyance belt, or the like causes a belt steering roller to unintendedly tilt, which in turns causes the belt to laterally shift in the unintended direction.

According to an aspect of the present invention, there is provided an image forming apparatus comprising a rotatable endless belt; image forming means for forming a toner image on said endless belt; stretching means for stretching said endless belt; an inclining device for inclining said endless belt so as to keep said endless belt in a normal range in a widthwise direction of said endless belt, said inclining device including a rotatable portion rotatable with rotation of said endless belt, a frictional portion, provided at opposite end portions of said rotatable portion with respect to the widthwise direction of said endless belt, to be rubbed by said endless belt, supporting means for supporting said rotatable portion and said frictional portion, a rotational shaft for rotatably supporting said supporting means, wherein said supporting means rotatable by force produced by the rubbing between said endless belt and said frictional portion to move said endless belt in the widthwise direction; a blade member, provided opposed to said rotatable portion of said inclining device through said endless belt, for pressing against said endless belt at a pressing portion to clean said endless belt; a detecting portion for detecting that said endless belt is deviated from the normal range in the widthwise direction; and an executing portion for executing an operation in a mode in which a lubricant is supplied to the pressing portion, when said detecting portion detects that said endless belt is deviated from the normal range in the widthwise direction.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, the embodiments of the present invention are described with reference to the appended drawings. Incidentally, not only is the present invention applicable to the image forming apparatuses in the following embodiments of the present invention, but also, image forming apparatuses which are partially or entirely different in structure from the image forming apparatuses in the following embodiments, as long as they are structured so that lubricant is intermittently supplied to their belt to stabilize in operation, their automatic belt aligning mechanism.

That is, the present invention is applicable to any image forming apparatus, whether the apparatus is of the tandem type or has only a single image bearing member (drum), and also, whether the apparatus is of the intermediary transfer type or direct transfer type, as long as the apparatus employs an automatic belt aligning mechanism for controlling the lateral shift of its endless belt. The belt which an image forming apparatus to which the present invention is applied may be an intermediary transfer belt, a recording medium conveyance belt, or a fixation belt. The lubricant which an image forming apparatus to which the present invention is applied does not need to be limited to toner. In the description of the following embodiments of the present invention, only the portions which are essential to the formation and transfer of a toner image are described. However, the present invention is applicable to various image forming apparatuses other than those in the following embodiments of the present invention. For example, it is applicable to various printer, copying machines, facsimile machines, and also, multifunction apparatuses capable of performing two or more the preceding machines, which are combinations of one of the image forming apparatuses in the following embodiments, additional devices, equipments, frames, etc.

<Image Forming Apparatus>

Figure 1:
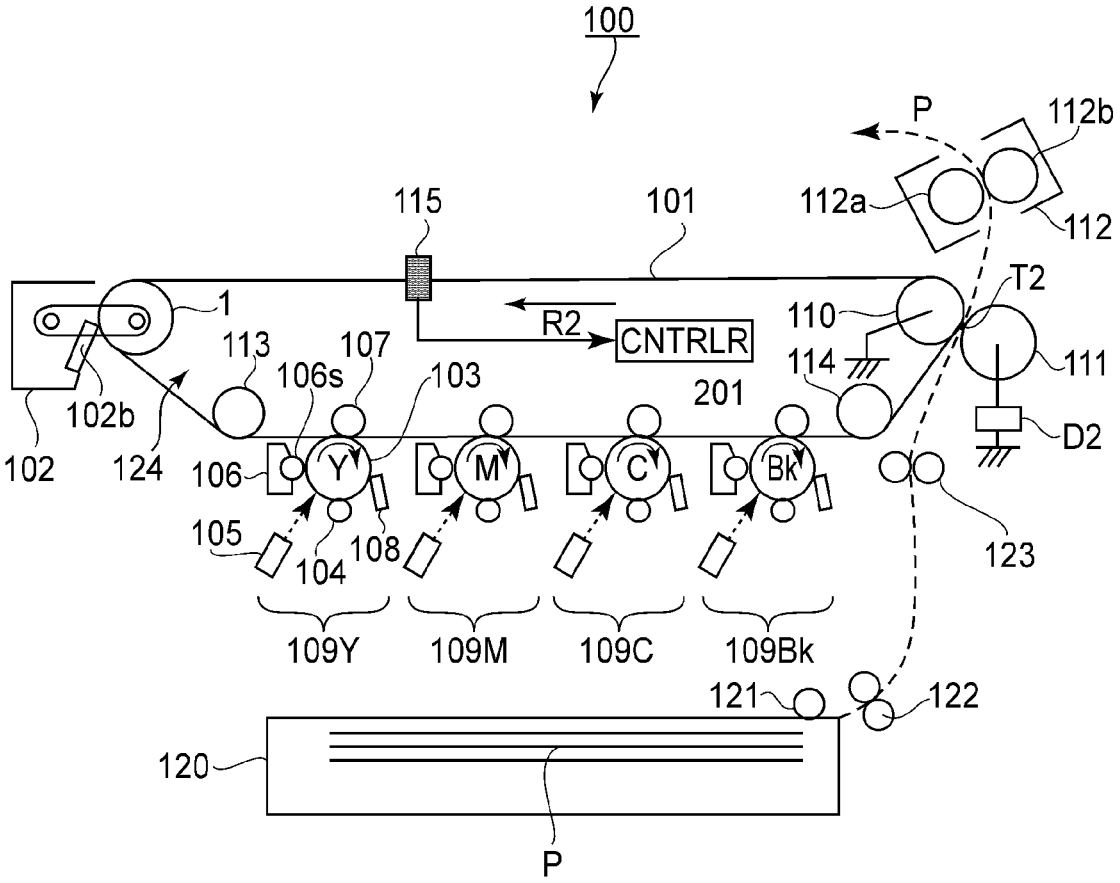
FIG. 1 is a schematic sectional view of the image forming apparatus in the first embodiment of the present invention, and shows the general structure of the apparatus.

FIG. 1 is a drawing for describing the general structure of a typical image forming apparatus to which the present invention is applicable. Referring to FIG. 1, the image forming apparatus 100 is a full-color printer of the so-called tandem type, and also, of the so-called intermediary transfer type. More concretely, it has an intermediary transfer belt 101, and four image forming stations 109Y, 109M, 109C and 109Bk. The image forming stations 109Y, 109M, 109C and 109Bk form yellow, magenta, cyan and black toner images, respectively, are aligned along the image bearing surface of the intermediary transfer belt 101.

In the image forming station 109Y, a yellow toner image is formed on a photosensitive drum 103, and is transferred onto the intermediary transfer belt 101. In the image forming station 109M, a magenta toner image is formed through the procedure similar to that used in the image forming station 109Y, and is transferred onto the intermediary transfer belt 101 in such a manner that the magenta toner image is layered on the yellow toner image on the intermediary transfer belt 101. In the image forming stations 109C and 109Bk, a cyan toner image and a black toner image, respectively, are formed through the procedure similar to that used in the image forming station 109Y, and are sequentially transferred onto the intermediary transfer belt 101 in such a manner that the cyan and black toner images are sequentially layered onto the yellow and magenta toner images on the intermediary transfer belt 101.

The four toner images, different in color, on the intermediary transfer belt 101 are conveyed to the secondary transfer station T2, and are transferred together (secondary transfer) onto a sheet P of recording medium in the secondary transfer station T2. After the transfer (secondary transfer) of the four toner image, different in color, onto the sheet P of recording medium, the sheet P is separated from the intermediary transfer belt 101, with the utilization of the curvature of the intermediary transfer belt 101, and then, is sent into the fixing device 112 of the image forming apparatus 100. The fixing device 112 fixes (welds) the toner images on the sheet P to the surface of the sheet P by applying heat and pressure to the sheet P and the toner images thereon. Thereafter, the sheet P is discharged from the image forming apparatus.

The image forming stations 109Y, 109M, 109C and 109Bk are practically the same in structure, although they are different in the color (yellow, magenta, cyan and black, respectively) of the toner their developing device uses. Therefore, the process for forming a toner image is described with reference to the image forming station 109Y, that is, the yellow image forming station. The process for forming toner image in the image forming stations 109M, 109C and 109Bk will not be described for the sake of not repeating the same description.

The image forming station 109Y has the photosensitive drum 103. It has also a charge roller 104, an exposing device 105, a developing device 106, and a drum cleaning device 108, which are in the adjacencies of the peripheral surface of the photosensitive drum 103. The photosensitive drum 103 has a photosensitive surface layer which is negatively chargeable. It is rotated at a preset process speed in the direction indicated by an arrow mark. As an oscillatory voltage, that is, a combination of DC voltage and AC voltage is applied to the charge roller 104, the charge roller 104 negatively charges the peripheral surface of the photosensitive drum 103 to a preset potential level, which is equivalent to the potential level VD of an unexposed point of a latent image to be formed on the charged area of the peripheral surface of the photosensitive drum 103. The exposing device 105 writes on the peripheral surface of the photosensitive drum 103, an electrostatic latent image of the image to be formed, by scanning the charged area of the peripheral surface of the photosensitive drum 103 with a beam of laser beam with the use of a rotational mirror while modulating (turning on or off) the beam of laser light according to the image formation data obtained by unfolding the data of the yellow color component obtained by separating the image to be formed, into the primary color components of the image to be formed.

The developing device 106 makes its development sleeve 106*s* bear two-component developer made up of nonmagnetic toner and magnetic carrier, while charging the developer. It conveys the charged developer to the area in which virtually no space is present between the peripheral surface of the development sleeve 106*s* and peripheral surface of the photosensitive drum 103. Further, to the development sleeve 106*s*, a preset oscillatory voltage, which is a combination of DC and AC voltages, is applied, whereby the negatively charged nonmagnetic toner is made to transfer onto the exposed points of the peripheral surface of the photosensitive drum 103, which are positive in potential relative to the charged toner. Consequently, the electrostatic latent image on the peripheral surface of the photosensitive drum 103 is reversely developed.

Transfer roller 107 forms a transfer station between the peripheral surface of the photosensitive drum 103 and intermediary transfer belt 101. To the transfer roller 107, a preset positive voltage is applied, whereby the toner image on the peripheral surface of the photosensitive drum 103 is transferred onto the intermediary transfer belt 101. The drum cleaning device 108 recovers the toner remaining on the peripheral surface of the photosensitive drum 103 after the toner image transfer, by rubbing (scraping) the peripheral surface of the photosensitive drum 103 with its cleaning blade.

The secondary transfer roller 111 contacts the outward surface of the intermediary transfer belt 101, between the image forming station 109Bk and cleaning blade 102*b* in terms of the moving direction of the intermediary transfer belt 101. It forms the second transfer station T2 by being placed in contact with the portion of the intermediary transfer belt 101, which is supported by a belt backing roller 110 from the inward side of the belt loop.

The image forming apparatus 100 has a recording medium cassette 120, in which multiple sheets of recording medium are storable. Each sheet P of recording medium in the cassette 120 is taken out of the cassette 120 while being separated from the rest by a separation roller 122. Then, it is sent to a pair of registration rollers 123, which send the sheet P to the secondary transfer station T2 with such a timing that the sheet P arrives at the secondary transfer station T2 at the same time as the full-color image (made up of layered four monochromatic toner images different in color) on the intermediary transfer belt 101. Then, the toner images and sheet P of recording medium are conveyed together (in layers) through the secondary transfer station T2, while positive voltage is applied to the secondary transfer roller 111 from an electric power source D2. Consequently, the full-color image is transferred (secondary transfer) from the intermediary transfer belt 101 onto the sheet P.

<Intermediary Transfer Belt>

The intermediary transfer belt 101 is a member which is in the form of an endless belt. It is circularly moved in the direction indicated by an arrow mark R2. It is suspended and kept stretched by a driving roller 110 which is a belt driving member, a steering roller 1 which is a belt steering member, and a pair of plain rollers 113 and 114. The driving roller 110 doubles as the secondary transfer roller, and is placed in the inward side of the loop which the intermediary transfer belt 101 forms, at the secondary transfer station T2. The steering roller 1 doubles as a tension roller which provides the intermediary transfer belt 101 with a preset amount of tension. However, the number of the rollers by which the intermediary transfer belt 101 is suspended and kept stretched does not need to be limited to four as shown in FIG. 1. Further, the structural arrangement for keeping the intermediary transfer belt 101 suspended and stretched does not need to be limited to the one shown in FIG. 1.

The intermediary transfer belt 101 is desired not to wrinkle while it is being circularly driven. Thus, the material for the intermediary transfer belt 101 is desired to be highly resilient resin. More concretely, the material for the intermediary transfer belt 101 is desired to be PVDF (polyfluorovinylidene), polyamide, polyimide, PET (polyethylene-terephthalate), polycarbonate, or the like.

As for the thickness of the intermediary transfer belt 101, if it is excessively thin, it may not be able to withstand friction. On the other hand, if it is excessively thick, it may fail to conform to the curvature of the driving roller 110, steering roller 1, and plain rollers 113 and 114. That is, it may fail to properly bend. Therefore, it may develop indentations, or may buckle. Therefore, the thickness of the intermediary transfer belt 101 is desired to be in a range of 0.02 mm-0.50 mm. In the following embodiments of the present invention, the intermediary transfer belt 101 is a resin belt; its substrate is formed of polyimide. It is 18,000 N/cm$^2$ in coefficient of linear elasticity, and 0.08 mm in thickness.

The image forming apparatus 100 is provided with multiple image forming stations, which are different in the color in which they form a toner image. Further, it is structured so that the multiple image forming stations can simultaneously operate. Therefore, it is very high in productivity. The intermediary transfer belt 100 is an endless belt, onto the outward surface (in terms of loop it forms) of which toner images, different in color, are temporarily transferred in layers, and from which the layered toner images are transferred together onto a sheet P of recording medium. The intermediary transfer belt 101 is suspended and kept stretched by multiple rollers, for example, the driving roller 110, and is circularly movable. As an endless belt, such as the endless intermediary transfer belt of the image forming apparatus 100, which is suspended and kept stretched by multiple rollers, is circularly driven, it tends to laterally shift (it tends to shift in the direction perpendicular to its moving direction), due to the non-uniformity in the diameter of the rollers in terms of their lengthwise direction, inaccuracy in the alignment among the rollers, and/or the like issues.

As described above, one of the methods for controlling the lateral movement of an endless belt is to provide each of the lengthwise ends of each of the multiple belt supporting rollers with a rib. This method, however, suffers from the following problems. That is, the rib deforms the corresponding edge of the endless belt, exacerbating the snaking of the belt, and/or increasing the play between the belt and ribs. Consequently, the method fails to precisely position the belt in terms of the direction perpendicular to the moving direction of the belt. It is possible to provide the inward surface of the endless belt with ribs. This method, however, suffers from its own problem. That is, while the belt is circularly moved, the ribs remain continuously pressed by the belt in the direction perpendicular to the moving direction of the belt. Thus, this method does not allow the belt to be circularly driven faster than a certain velocity. It is also problematic in that the control of the process for pasting the ribs to the belt, and the examination of the belt in terms of the level of precision at which the ribs are adhered to the belt, add to the belt cost.

For the reasons given above, it is common practice to use a combination of a belt steering roller and an actuator in order to control the lateral shift of the endless belt. More concretely, the position of the belt in terms of the direction perpendicular to the moving direction of the belt (which hereafter may be referred simply as "belt position") is continuously detected, and the belt steering roller is continuously tilted in such a direction and an amount that cancel the amount by which the belt has shifted. However, controlling the steering roller with the use of an actuator requires a complicated control algorithm. It requires also electrical components such as sensors and actuators. Therefore, it is problematic in that it increases the intermediary transfer unit in size and cost.

Thus, the image forming apparatus 100 uses an automatic belt aligning device (steering roller tilting device) which is significantly smaller in component count, simpler in structure, and lower in cost than an automatic belt aligning device which uses an actuator to tilt the steering roller. More specifically, the image forming apparatus 100 uses an automatic belt aligning device which to unitizes the difference between the amount of friction between one of the lengthwise end portions of the belt steering roller 1 and the intermediary transfer belt 101, and the amount of friction between the other lengthwise end portion of the belt steering roller 1 and the intermediary transfer belt 101, to automatically control the intermediary transfer belt 101 in lateral shift.

<Automatic Belt Aligning Mechanism (Device)>

Figure 2:
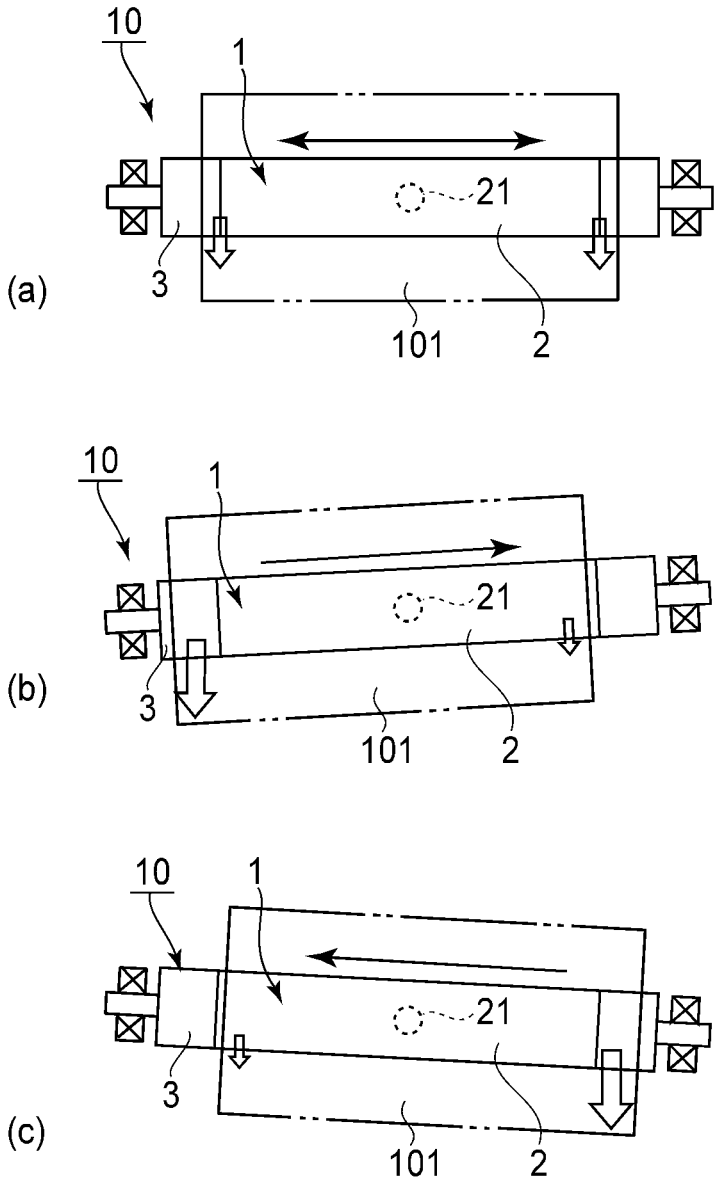
FIG. 2 is a drawing for describing the operation of the automatic belt aligning mechanism in the first embodiment of the present invention.
Figure 3:
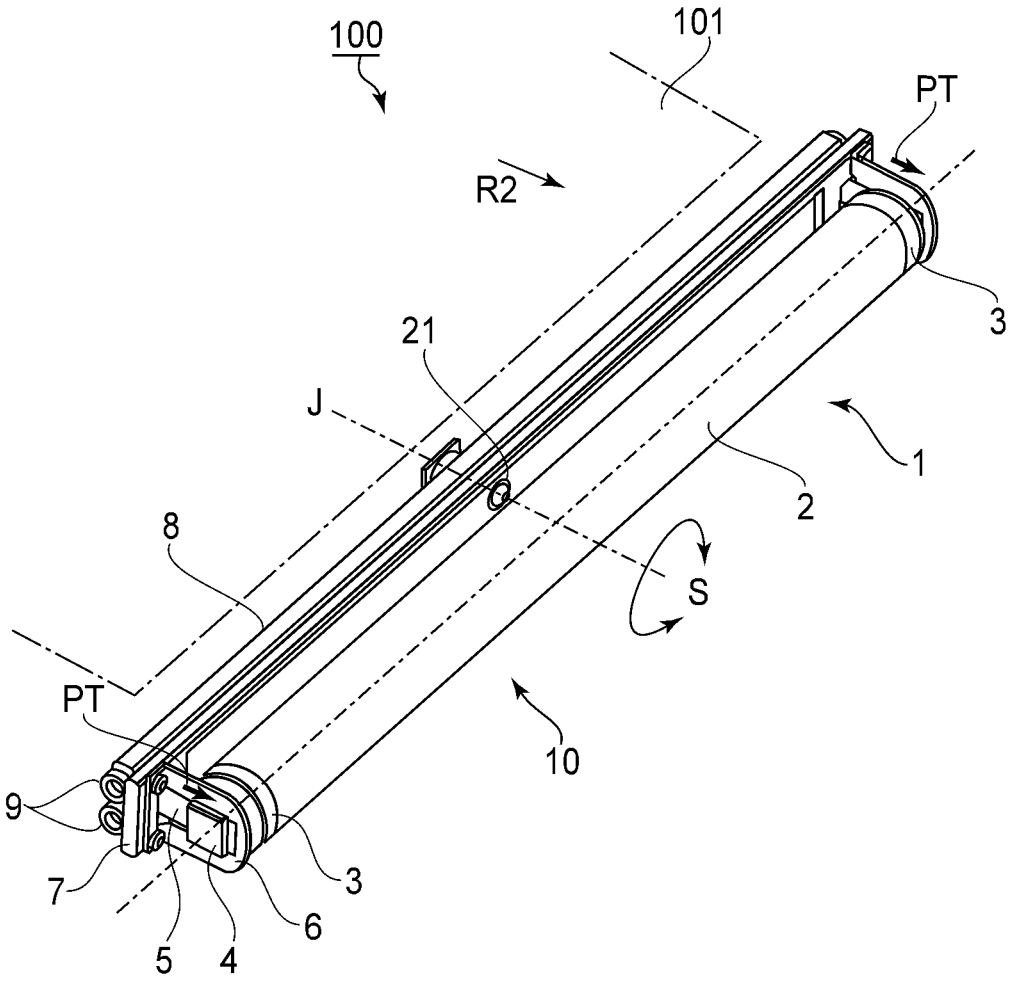
FIG. 3 is a perspective view of the automatic belt aligning mechanism in the first embodiment of the present invention.
Figure 4:
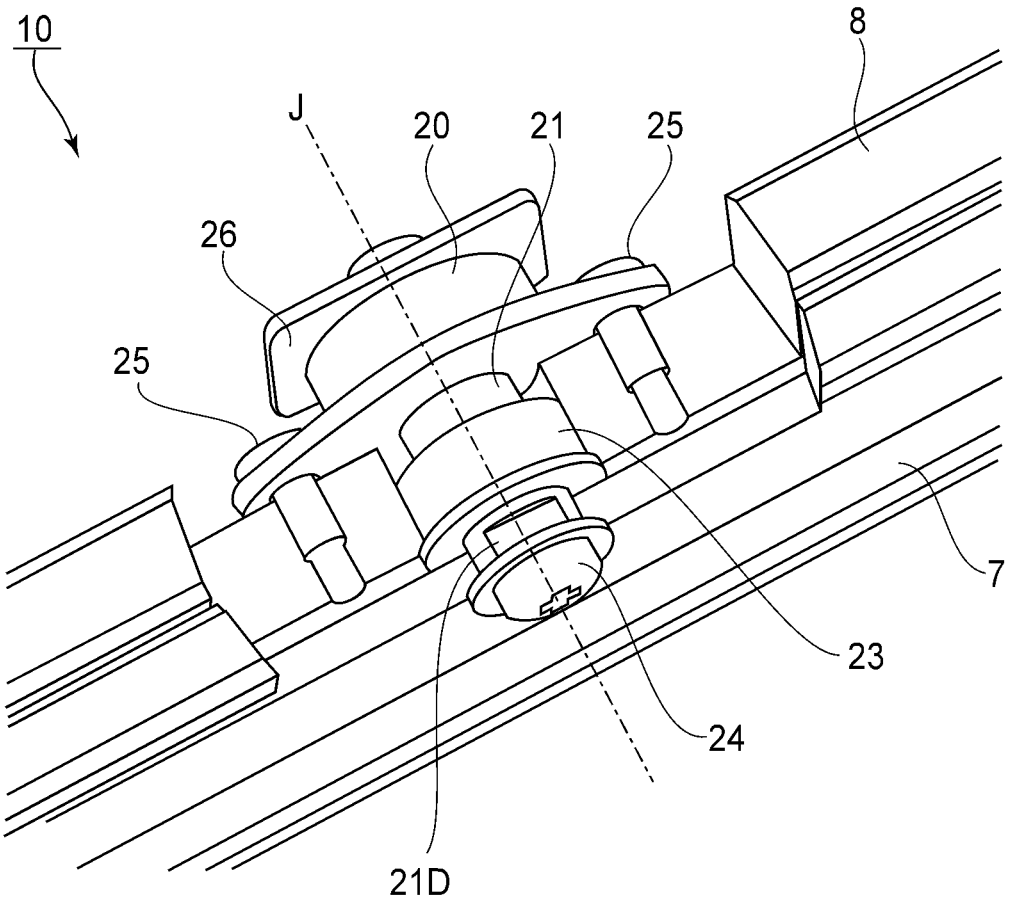
FIG. 4 is a perspective view of the center portion of the belt steering roller holder, in the first embodiment of the present invention, and shows how the belt steering roller holder is rotationally supported.
Figure 5:
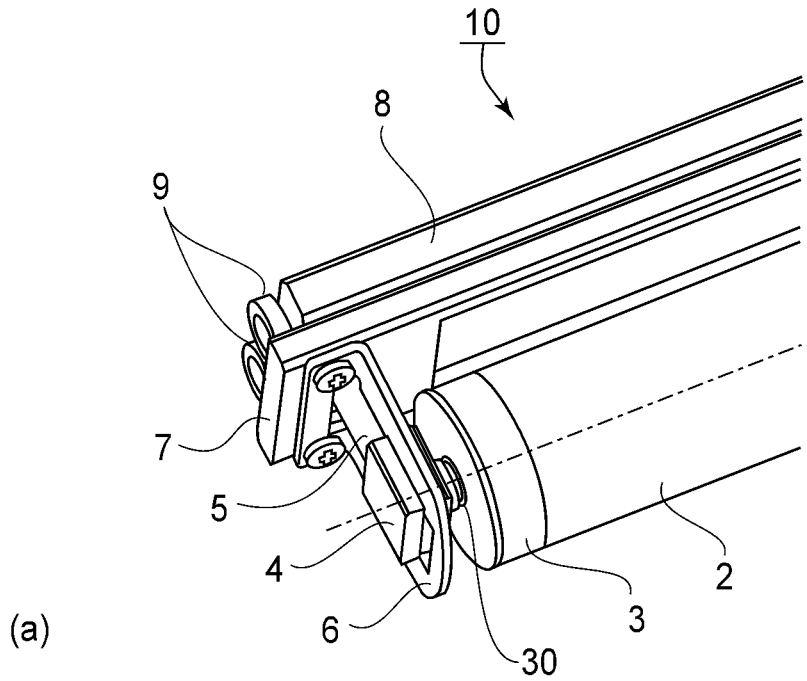
FIG. 5 is a perspective view of one of the lengthwise end portions of the automatic belt aligning mechanism, and shows how the belt steering roller is attached to the mechanism.
Figure 5:
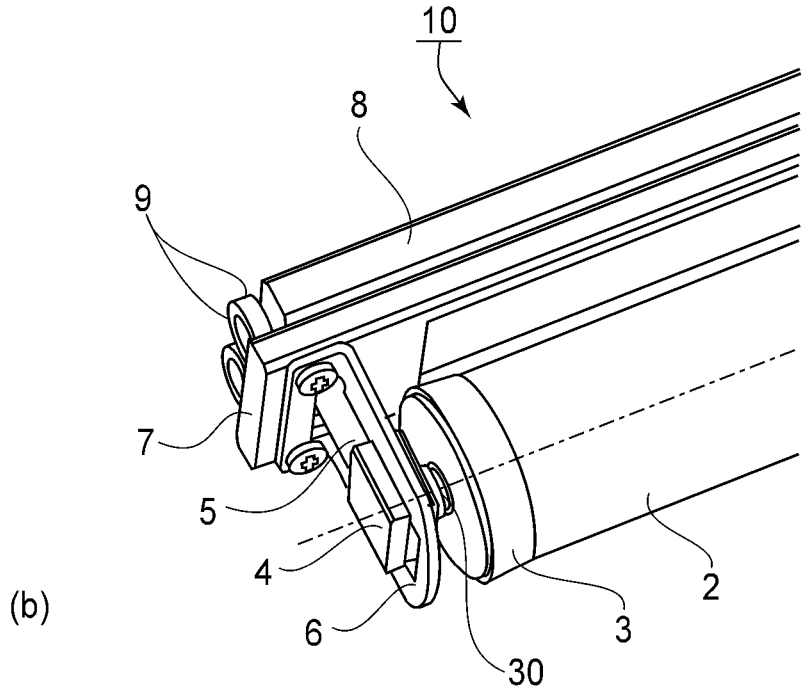
Figure 6:
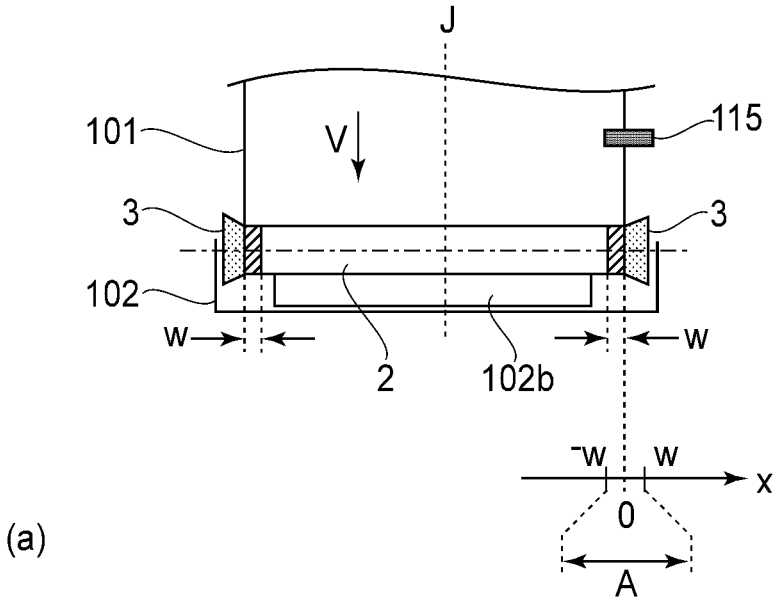
FIG. 6 is a drawing for describing the length of contact between the belt steering roller and intermediary transfer belt, in terms of the lengthwise direction of the steering roller.
Figure 6:
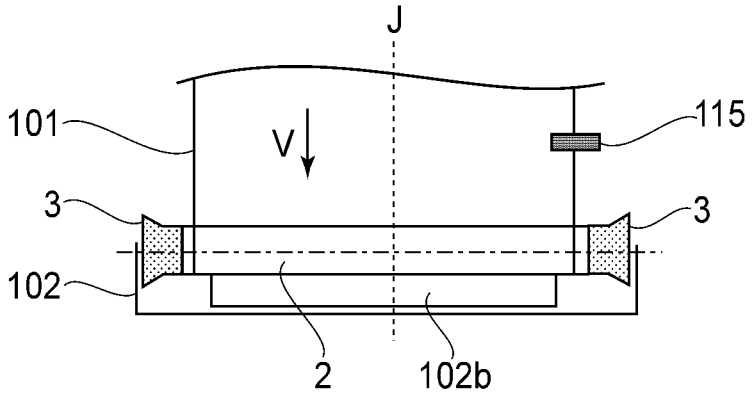

FIG. 2 is a drawing for describing the operation of the automatic belt aligning device. FIG. 3 is a perspective view of the automatic belt aligning device. FIG. 4 is a broken perspective view of the center portion of the automatic belt aligning device, in terms of the lengthwise direction of the device, and shows the structure of the center portion. FIG. 5 is a perspective view of one of the lengthwise end portions of the automatic belt aligning device, and shows how the belt steering roller 1 is held to the belt steering roller holding plate 7. FIG. 6 is a drawing for describing the relationship between the width of the intermediary transfer belt 101 and the length of the belt steering roller 1, and the width of contact between the intermediary transfer belt 101 and the belt steering roller 1 in terms of the lengthwise direction of the belt steering roller 1.

Referring to FIG. 2, the belt steering roller 1, which is an example of a belt steering component, is held in such a manner that it can be rotationally moved about its center in terms of its lengthwise direction, in parallel to a vertical plane which coincides with the axial line of the belt steering roller 1. Thus, as the intermediary transfer belt 101 laterally shifts, that is, as the intermediary transfer belt 101 shifts in the direction perpendicular to its moving direction, the amount of the friction between one of the lengthwise end portions of the belt steering roller 1 and the intermediary transfer belt 101 becomes different from the amount of the friction between the other lengthwise end portion of the belt steering roller 1 and the intermediary transfer belt 101, causing thereby the belt steering roller 1 to tilt in the direction to cancel the lateral shifting of the intermediary transfer belt 101. This automatic belt aligning device, which is based on mechanical feedback does not require a motor for tilting the belt steering roller 1. Therefore, it consumes absolutely no electric power to control the intermediary transfer belt 101 in lateral shift. Moreover, it requires no sensors for detecting the lateral shift of the intermediary transfer belt 101, no controlling means which computes the angle by which the belt steering roller 1 is to be tilted and activates the belt steering motor, and no driving force transmitting mechanism which converts the rotational angle of the motor into the angle by which the belt steering roller 1 is to be tilted. Thus, accuracy with which the intermediary transfer belt 101 is controlled in lateral shift has no relation to the accuracy with which the amount of the lateral shift of the intermediary transfer belt 101 is detected by sensors. Therefore, even if the sensors happen to fail to correctly detect the amount of the lateral shift of the intermediary transfer belt 101, it does not occur that the intermediary transfer belt 101 is unnecessarily shifted. Therefore, it does not occur that the intermediary transfer belt 101 is made to snake by sensor errors.

In terms of the lengthwise direction of the belt steering roller 1, the belt steering roller 1 is made up of three sections: a center section and a pair of lengthwise end sections. The center section is rotatable, whereas the lengthwise end sections are not rotatable. Therefore, the amount of load to which the intermediary transfer belt 101 is subjected by each lengthwise section of the intermediary transfer belt 101 is far greater than that to which the intermediary transfer belt 101 is subjected by the center section of the belt steering roller 1. Further, the each lengthwise end section of the belt steering roller 1 is tapered in such a manner that the farther from the lengthwise center of the belt steering roller 1, the greater the external diameter. Therefore, the mechanical feed back is less likely to be affected by the change in the amount of friction between the 1 and intermediary transfer belt 101 than if the lengthwise end sections are uniform in external diameter. In other words, tapering the lengthwise end sections of the belt steering roller 1 makes the automatic belt aligning device stable in the effect of automatically aligning the intermediary transfer belt 101.

Referring to FIG. 2(*a*), the automatic belt aligning mechanical device 10 utilizes the imbalance between the lengthwise end portions of the belt steering roller 1, in terms of the friction between the belt steering roller and intermediary transfer belt 101, in order to make the belt steering roller 1 automatically control the intermediary transfer belt 101 in lateral shift. The belt steering roller 1 is supported by a steering shaft 21 so that the belt steering roller 1 is rotationally movable about the axial line of the steering shaft 21. In terms of the lengthwise direction of the belt steering roller 1, the center section 2 of the belt steering roller 1 is rotatable (by intermediary transfer belt 101), whereas the lengthwise end sections 3 of the belt steering roller 1 are not rotatable (by intermediary transfer belt 101), being substantially higher in the amount of friction between themselves and intermediary transfer belt 101 than that between the center section 2 and intermediary transfer belt 101.

When the left and right edge portions of the intermediary transfer belt 101 are on the left and right nonrotational sections 3 (which hereafter may be referred to as friction rings), the left and right end portions of the intermediary transfer belt 101 are equal in the amount of friction between the belt steering roller 1 and intermediary transfer belt 101, and therefore, the steering roller 1 does not tilt. As the intermediary transfer belt 101 is made to laterally shift as shown in FIG. 2(*b*) or 2(*c*) by external disturbance, the belt steering roller 1 automatically tilts in the direction to compensate for the lateral shift of the intermediary transfer belt 101, by an angle necessary to compensate for the lateral shift of the intermediary transfer belt 101. Thus, the intermediary transfer belt 101 moves back into the state shown in FIG. 2(*a*).

Referring to FIG. 2(*b*), if the intermediary transfer belt 101 shifts leftward relative to its moving direction, it begins to ride on the left friction ring 3 of the belt steering roller 1, increasing thereby the left side of the intermediary transfer belt 101 greater in the amount of friction between the intermediary transfer belt 101 and belt steering roller 1. As a result, the belt steering roller 1 tilts in such a direction that its left side becomes lower than its right side, generating thereby such a force that causes the intermediary transfer belt 101, which is being moved in such a manner as to wrap around the belt steering roller 1, to shift rightward. Thus, the intermediary transfer belt 101 moves rightward, automatically cancelling the leftward shift to which has just occurred.

Next, referring to FIG. 2(*c*), if the intermediary transfer belt 101 shifts rightward relative to its moving direction, it begins to ride on the right friction ring 3 of the belt steering roller 1, increasing thereby the right side of the intermediary transfer belt 101 greater in the amount of friction between the intermediary transfer belt 101 and belt steering roller 1. As a result, the belt steering roller 1 tilts in such a direction that its right side becomes lower than its left side, generating thereby such a force that causes the intermediary transfer belt 101, which is being moved in such a manner as to wrap around the belt steering roller 1, to shift left. Thus, the intermediary transfer belt 101 moves left, automatically cancelling thereby the rightward shift which has just occurred.

Referring to FIG. 3, the automatic belt aligning mechanical device 10 is structured so that the belt steering roller 1 automatically aligns the intermediary transfer belt 101; the imbalance in the amount of friction between the left friction ring 3 and intermediary transfer belt 101 and that between the right friction ring 3 and intermediary transfer belt 101 causes the belt steering roller 1 to automatically align the intermediary transfer belt 101. The center section 2 of the belt steering roller 1, that is, the belt steering roller 1 minus the left and right lengthwise sections, takes up the major portion of the belt steering roller 1, in terms of the direction parallel to the axial line of the belt steering roller 1. It is rotatable by the intermediary transfer belt 101. In comparison, each of the lengthwise end sections of the belt steering roller 1 is a friction ring 3. While the center section 2 (rotatable section) is rotated by the circular movement of the intermediary transfer belt 101, the friction ring 3 cannot be rotated by the circular movement of the intermediary transfer belt 101. Therefore, as the intermediary transfer belt 101 is circularly moved, it rubs the friction ring section 3 of the belt steering roller 1, generating friction between itself and the friction rings 3.

The automatic belt aligning mechanism has a rotationally movable plate 7, which has a pair of plates 6 for supporting the belt steering roller 1. The steering roller supporting plates 6 are at the lengthwise ends of the rotationally movable plate 7, one for one, and are perpendicular to the plate 7. The rotational plate 7 and steering roller supporting plates 6 make up a holder for supporting the belt steering roller 1. The automatic belt aligning mechanical device 10 has also a pair of sliding bearings 4, which are at the lengthwise ends of the mechanism, one for one. The sliding bearings rotatably support the belt steering roller 1. Each bearing is fitted in the groove, with which the corresponding steering roller supporting plate 6 is provided. It is under the pressure from a compression spring 5, remaining pressured in the direction indicated by an arrow mark PT. Thus, the steering roller 1 functions also as a tension roller for providing the intermediary transfer belt 101 with a preset amount of tension. That is, because each of the lengthwise ends of the belt steering roller 1 is kept pressed by the compression spring 5 in the direction indicated by the arrow mark RT, the steering roller presses on the inward surface of the intermediary transfer belt 101, providing thereby the intermediary transfer belt 101 with the preset amount of tension.

The rotational plate 7 is supported by a frame stay 8. More specifically, the rotational plate 7 is rotatably supported by a steering shaft (21 in FIG. 3) so that it can be rotationally moved about the axial line J of the steering shaft 21. The frame stay 8 is between the side plates of the intermediary transfer unit (124 in FIG. 1), and extends from one side plates to the other. It is a part of the boxy frame of the unit 124. The frame stay 8 has a pair of sliding rollers 9, which are at the lengthwise ends of the stay 8. The rollers 9 play the role of reducing the friction which occurs as the rotational plate 7 is rotationally moved.

Referring to FIG. 4, the steering shaft 21, which is a rotatable shaft, is fitted in the hole with which the center portion of the rotational plate 7 is provided. It is solidly attached to the rotational plate 7 with a small screw 24. One end 21D of the steering shaft 21 is shaped so that its cross section is in the form of a letter D. Therefore, the steering shaft 21 can be held nonrotationally by a tool when the intermediary transfer unit 124 is assembled. More concretely, the steering shaft 21 is rotatably supported by a bearing 23 (ball bearing) solidly attached to the frame stay 8, by being put through the bearing 23. The opposite end of the steering shaft 21 from where the small screw 24 has a stopper 26 for preventing the steering shaft 21 from disengaging from the frame stay 8. The automatic belt aligning mechanical device 10 is also provided with a rotary dumper 20, which is fitted around the steering shaft 21. The rotary dumper 20 is attached to the frame stay 8 with a pair of small screws 25.

The rotary dumper 20 generates viscous resistance (drag) as the belt steering roller 1 is rotationally moved in an oscillatory manner. It is at the center of the automatic belt aligning mechanical device 10 in terms of the lengthwise direction of the mechanism 10. It is a device which uses viscous drag of oil or the like to generate resistance to the rotational movement of the belt steering roller 1. It increases (proportionally, in theory) resistance in proportion to the shear speed (rotational speed) of the steering shaft 21. Thus, as the change, per unit length of time, in the speed with which the steering shaft 21 rotates in an oscillatory manner, increases, the rotary dumper 20 increases in the rotational drag which works against the rotation of the steering shaft 21. Therefore, the noises in the change in the difference between the lengthwise ends of the belt steering roller 1 in terms of the friction between the belt steering roller 1 and intermediary transfer belt 101 are eliminated. Therefore, the automatic belt aligning mechanical device 10 stabilizes in the oscillatory movement of the belt steering roller 1.

A straight ring, that is, a ring which is uniform in external diameter in terms of direction parallel to its axial line as shown in FIG. 5(*a*) may be used as each of the friction rings 3 of the belt steering roller 1. In a case where a straight ring is employed as the friction ring 3, the coefficient $\mu s$ of the static friction of the friction ring 3 is desired to be set to roughly 0.6 ($\mu s \approx 0.6$).

Further, a tapered ring, that is, a ring shaped so that the more outward in terms of the direction parallel to the axial line of the belt steering roller 1 as shown in FIG. 5(*b*), the larger the external diameter, may be employed as the friction ring 3. In a case where a tapered ring is employed as the friction ring 3, it may be less in coefficient $\mu s$ of static friction than a straight ring. More concretely, if the angle $\phi$ of taper of the tapered ring is 8° (ϕ=8°), the tapered ring is desired to be roughly 0.3 (μs≈0.3) in coefficient μs of static friction.

In either case, it is assumed that the coefficient of friction of the surface of the friction ring 3 is set to be larger than that of the rotational section 2 of the belt steering roller 1. As the material for the friction ring 3, a resinous substance, such as polyacetal (POM), which is slippery, is used. In consideration of the ill effects of the static electricity attributable to the friction between the friction ring 3 and intermediary transfer belt 101, the friction ring 3 is made electrically conductive.

The rotational section 2 of the belt steering roller 1 is made of aluminum. It is made to be roughly 0.1 in the coefficient μSTR of static friction of its surface (μSTR≈0.1). However, as long as it is less than that of the friction ring 3, it may be made of a substance other than aluminum. The coefficient of friction of the friction ring 3 and that of the rotational section 2 were measured with the use of Coefficient of Friction Testing Method (JIS K7125) for plastic, film, sheet, etc. More concretely, a sheet of polyimide, which is the material for the inward layer (substrate) of the intermediary transfer belt 101, was used as the test piece.

One of the lengthwise end portions of the steering roller shaft 30 is made D-shaped in cross section so that it can be nonrotationally supported by the sliding bearing 4. The rotational section 2 of the belt steering roller 1 is rotatably supported by the steering roller shaft 30, with the presence of bearings which are in the rotational section 2. In comparison, the friction rings 3, which make up the lengthwise end portions of the belt steering roller 1, one for one, are nonrotationally supported by the steering roller shaft 30 with the use of a pair of parallel pins.

Therefore, when the intermediary transfer belt 101, which is suspended and kept stretched by the steering roller 1 and the other rollers, is circularly moved, the inward surface of the intermediary transfer belt 101 does not rub the rotational section 2 of the belt steering roller 1, but, it rubs the friction rings 3, which make up the lengthwise end portions of the belt steering roller 1, one for one, generating thereby a substantial amount of friction between itself and each of the friction rings 3.

However, it is not mandatory that the friction rings 3 are nonrotationally fitted around the steering roller shaft 30. That is, the automatic belt aligning mechanical device 10 may be structured so that the friction rings 3 are rotatable. However, in a case where the automatic belt aligning mechanical device 10 is structured so that the friction rings 3 are rotatable, the amount of torque necessary to rotate the friction rings 3 in the circular moving direction of the intermediary transfer belt 101 needs to be greater than the amount of torque necessary to rotate the rotational section 2 of the belt steering roller 1 in the moving direction of the intermediary transfer belt 101.

The automatic belt aligning mechanical device 10 is structured as described above. Therefore, as the area of contact between one of the friction ring portions 3 of the belt steering roller 1 and the intermediary transfer belt 101 becomes greater than a certain value (preset value) as shown in FIG. 2(*b*) or 2(*c*), the lengthwise end of the steering roller 1, which became greater in the friction between the belt steering roller 1 (friction roller 3) and intermediary transfer belt 101, is pulled downstream in terms of the moving direction of the intermediary transfer belt 101 by the intermediary transfer belt 101. As a result, the belt steering roller 1 tilts in such a direction that its lengthwise end which is greater in the friction between its friction ring 3 and the intermediary transfer belt 101 will be on the downstream side relative to the other lengthwise end of the belt steering roller 1. In other words, the belt steering roller 1 begins to steer the intermediary transfer belt 101. The angle by which the belt steering roller 1 tilts is proportional to the imbalance between the lengthwise ends of the belt steering roller 1 in terms of the friction between the belt steering roller 1 and intermediary transfer belt 101.

Referring to FIG. 6(*a*), the width of the intermediary transfer belt 101 is greater than the length of the rotational section 2 of the belt steering roller 1, and less than the length of the belt steering roller 1 (rotational section 2+frictional ring sections 3). When the intermediary transfer belt 101 is remaining idealistically (perfectly) aligned (centered) relative to the belt steering roller 1 by the automatic belt aligning mechanical device 10, the length (area) of contact, in terms of the widthwise direction of the intermediary transfer belt 101, between the intermediary transfer belt 101 and one of the friction ring sections 3 and the length (area) of contact between the intermediary transfer belt 101 and the other friction ring section 3 are the same, being w (hatched portions in FIG. 6(*a*)). When the positional and dimensional relationships between the intermediary transfer belt 101 and belt steering roller 1 are as shown in FIG. 6(*a*), even if the intermediary transfer belt 101 laterally shifts, it is ensured that the intermediary transfer belt 101 remains wrapped around at least one of the friction ring sections 3; there is friction between the intermediary transfer belt 101 and at least one of the friction ring sections 3. That is, even after the intermediary transfer belt 101 laterally shifted, the intermediary transfer belt 101 continues to rub at least one (or both) of the friction ring sections 3.

Next, referring to FIG. 6(*b*), in a case where the width of the intermediary transfer belt 101 is less than the length of the rotational section 2 of the belt steering roller 1, even if the intermediary transfer belt 101 laterally shifts, the belt steering roller 1 is not tilted until the intermediary transfer belt 101 begins to ride onto (and rub) one of the friction ring sections 3. Therefore, it is liable that the belt steering roller 1 is abruptly tilted (controlled) the moment the intermediary transfer belt 101 begins to ride onto one of the friction ring sections 3. In principle, even if the positional and dimensional relationships between the intermediary transfer belt 101 and belt steering roller 1 are as shown in FIG. 6(*b*), it is possible to utilize the imbalance in the amount of friction between the left and right sides of the automatic belt aligning mechanical device 10 to automatically align the intermediary transfer belt 101. However, in a case where the positional and dimensional relationships between the intermediary transfer belt 101 and belt steering roller 1 are as shown in FIG. 6(*a*), the state of balance in terms of the friction between the left and right side of the automatic belt aligning mechanical device 10 can be always detected, and the steering roller 1 is unlikely to suddenly change in angle. Therefore, it is possible to incessantly control the intermediary transfer belt 101 in lateral shift.

<Belt Cleaning Device>

Referring to FIG. 1, a cleaning blade 102*b* is an example of a component placed in contact with the intermediary transfer belt 101. It is placed in parallel to the belt steering roller 1 so that it contacts the outward surface of the portion of the intermediary transfer belt 101, which is supported by the belt steering roller 1.

Next, referring to FIG. 6(*a*), the transfer residual toner, that is, the toner having failed to be transferred onto a sheet P of recording medium, and therefore, remaining on the intermediary transfer belt 101 after the secondary transfer, is recovered by the cleaning blade 102*b* of a belt cleaning device 102. The cleaning blade 102*b*, which is formed of urethane rubber, is positioned so that it opposes the steering roller 1 with the presence of the intermediary transfer belt 101 between itself and belt steering roller 1, and also, so that its base portion is on the upstream side of its cleaning edge in terms of the moving direction of the intermediary transfer belt 101. If the cleaning blade 102*b* presses the intermediary transfer belt 101 upon the friction rings 3, the friction between the intermediary transfer belt 101 and friction rings 3 will excessively increases. Therefore, the length of contact between the cleaning blade 102*b* and intermediary transfer belt 101 is made to be less than the length of the rotational sections 2 of the belt steering roller 1.

The state of contact (that is, friction) between the cleaning blade 102*b* and intermediary transfer belt 101 has to be uniform across the area of contact between the cleaning blade 102*b* and intermediary transfer belt 101 in terms of the lengthwise direction of the cleaning blade 102*b*. Therefore, the cleaning blade 102*b* is held so that it always remains parallel to the belt steering roller 1. That is, the belt cleaning apparatus 102 comprises the pair of the aforementioned steering roller supporting lateral plates 6 for supporting the belt steering roller 1 by the lengthwise ends of the belt steering roller 1, and an arm (unshown) solidly attached to the steering roller supporting lateral plates 6. The cleaning device 102 is supported by the arm (unshown) by its lengthwise ends in such a manner that it is rotationally moved with the belt steering roller 1 in the oscillatory manner. Thus, as the belt steering roller 1 is tilted, the belt cleaning device 102 tilts with the belt steering roller 1. Therefore, the cleaning edge of the cleaning blade 102*b* is kept pressed against the belt steering roller 1 with the presence of the intermediary transfer belt 101 between itself and belt steering roller 1, at the same location in terms of the rotational direction of the belt steering roller 1 (moving direction of intermediary transfer belt 101). Therefore, even if the intermediary transfer belt 101 laterally shifts, and therefore, the steering roller 1 tilts, the state of contact between the intermediary transfer belt 101 and cleaning blade 102*b* does not change, and therefore, the cleaning blade 102*b* continues to satisfactorily recover the transfer residual toner.

In the following embodiments of the present invention, the angle of the cleaning blade 102*b* of the belt cleaning device 102 is 25°, and the contact pressure between the cleaning blade 102*b* and intermediary transfer belt 101 is 30 N/m (30 gf/cm). The hardness of the cleaning blade (formed of urethane rubber) is 75 degrees in JIS hardness scale A, and the thickness of the cleaning blade 102*b* is 2 mm. However, the following embodiments of the present invention are not intended to limit the present invention in terms of the specifications of the belt cleaning device 102.

However, when the transfer residual toner on the intermediary transfer belt 101 is removed by the cleaning blade 102*b*, the friction between the intermediary transfer belt 101 and cleaning blade 102*b* acts as external disturbance upon the intermediary transfer belt 101. The effect of this phenomenon becomes very conspicuous as the nip between the intermediary transfer belt 101 and cleaning blade 102*b* reduces in the amount of the toner and its external additive, or runs out of the toner and/or external additive, and therefore, the friction between the intermediary transfer belt 101 and cleaning blade 102*b* increases. If the effect of this phenomenon becomes excessive, the automatic belt aligning mechanical device 10 fails to normally operate; it fails to automatically align (center) the intermediary transfer belt 101. Therefore, such problems are likely to occur that the image forming apparatus 100 outputs images suffering from color deviation, that the intermediary transfer belt 101 laterally shifts beyond recovery, or the like.

The automatic belt aligning mechanical device 10 utilizes the friction between the intermediary transfer belt 101 and friction rings 3 to keep the intermediary transfer belt 101 aligned (centered). However, if the friction between the intermediary transfer belt 101 and cleaning blade 102*b* becomes excessive, the friction is likely to prevent the automatic belt aligning mechanical device 10 from normally function, allowing thereby the intermediary transfer belt 101 to laterally shift beyond recovery.

Therefore, in the following embodiments of the present invention, the image forming apparatus 100 is operated in the lubrication mode to ensure that even when the intermediary transfer belt 101 is cleaned by the cleaning blade 102*b*, the intermediary transfer belt 101 is kept automatically aligned (centered) with the utilization of the imbalance in the amount of friction between the left and right sides of the belt steering roller 1.

Embodiment 1

Figure 7:
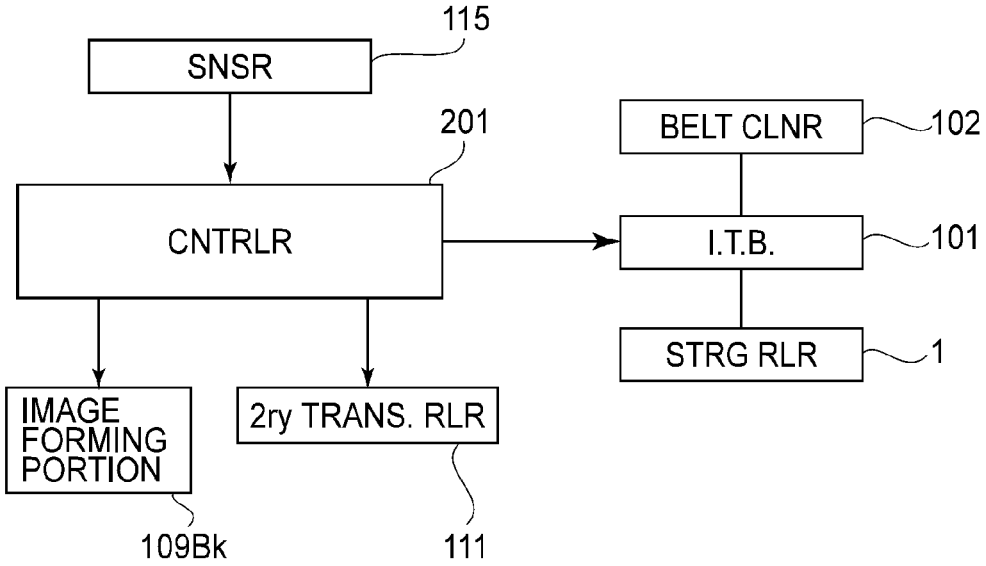
FIG. 7 is a block diagram of the control system, in the first embodiment, which is for operating the image forming apparatus in the lubrication mode.
Figure 8:
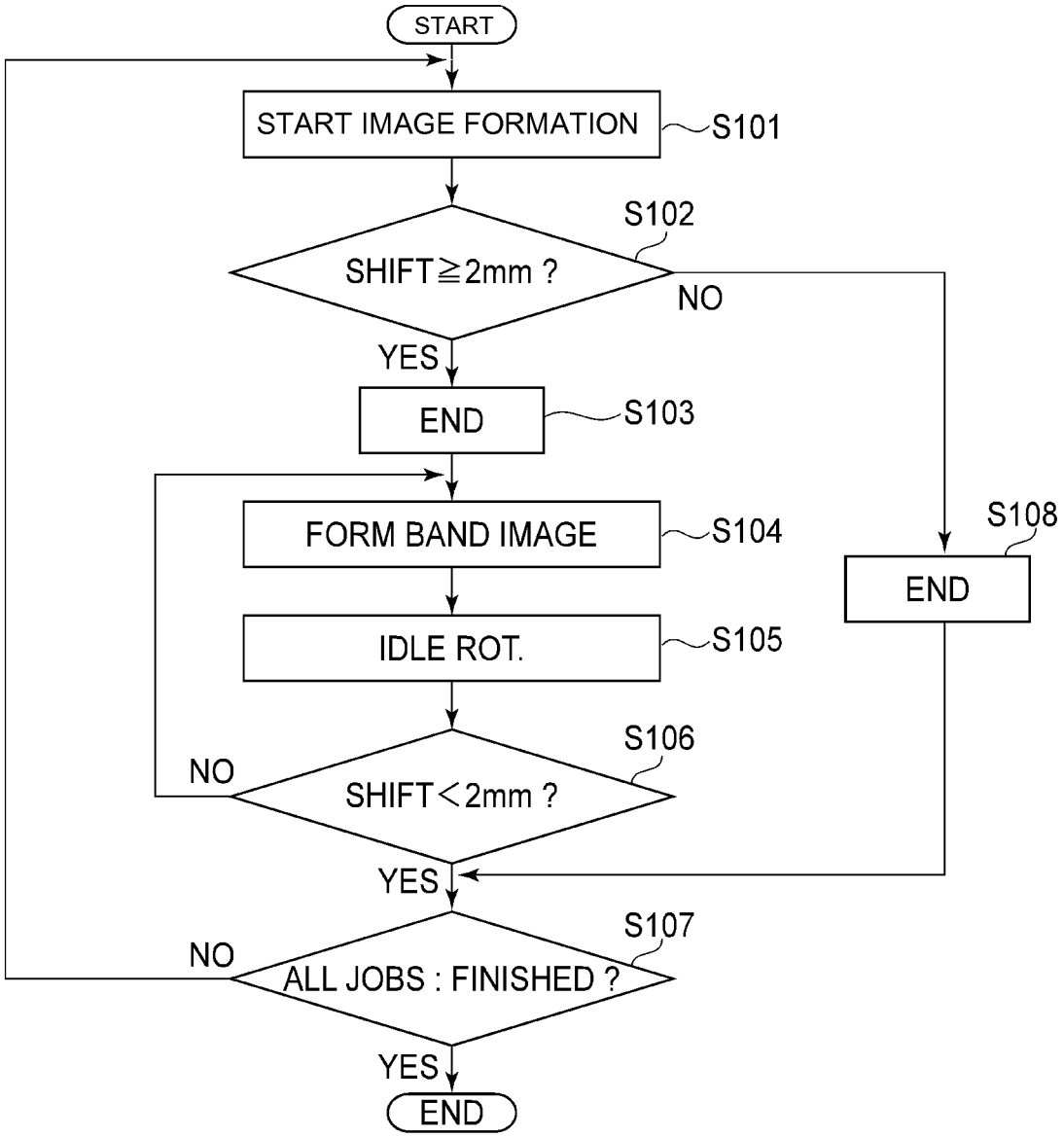
FIG. 8 is a flowchart of the control sequence for the lubrication mode in the first embodiment.

FIG. 7 is a block diagram of the control system, in the first embodiment, for operating the image forming apparatus 100 in the lubrication mode. FIG. 8 is a flowchart of the control sequence, in the first embodiment, to be carried out in the lubrication mode.

Referring to FIG. 1, the image forming station 109Bk, which is an example of a lubricant supplying section, is capable of supplying the intermediary transfer belt 101 with lubricant. More concretely, the image forming station 109Bk forms a toner image on the photosensitive drum 103 (which is an example of an image bearing member), and transfers the toner image as lubricant onto the intermediary transfer belt 101.

If the amount of the lateral shift of the intermediary transfer belt 101 exceeds a preset acceptable range, the control section 201, which is an example of a controlling means, operates the image forming apparatus 100 in the lubrication mode. In the lubrication mode, the control section 201 makes the image forming station 109Bk supply the intermediary transfer belt 101 with lubricant, and makes the intermediary transfer belt 101 carry the lubricant to the area of contact between the intermediary transfer belt 101 and cleaning blade 102*b*. Also in the lubrication mode, while the toner image transferred onto the intermediary transfer belt 101 from the image forming station 109Bk is conveyed through the secondary transfer station T2, such voltage that is the same in polarity as the toner charge is applied to the secondary transfer roller 111 from an electrical power source D2.

Referring to FIG. 6(*a*), the image forming apparatus 100 is provided with a belt position sensor 115, which detects the position of the intermediary transfer belt 101 in terms of the widthwise direction of the intermediary transfer belt 101. In the first embodiment, the belt position sensor 115 is an optical sensor (photo-interrupter), and is positioned so that it overlaps with one of the edges of the intermediary transfer belt 101. The sensor 115 (photo-interrupter) is made up of a pair of optical elements (light emitter and light receptor), and detects the position of the intermediary transfer belt 101 based on the amount of light received by the light receptor. However, the image forming apparatus 100 may be structured so that an optical sensor of the reflection type is used in stead of the photo-interrupter, or the edge position of the intermediary transfer belt 101 is mechanically detected.

The belt position, in which the intermediary transfer belt 101 is when the length of contact between the intermediary transfer belt 101 and one of the lengthwise end portions of the belt steering roller 1 in terms of the lengthwise direction of the belt steering roller 1 (widthwise direction of intermediary transfer belt 101) is equal to the length of contact between the intermediary transfer belt 101 and the other end portion of the belt steering roller 1, is the normal position of the intermediary transfer belt 101. Thus, the amount of lateral shift of the intermediary transfer belt 101 is defined as the distance between the current position of the intermediary transfer belt 101 and the normal position of the intermediary transfer belt 101. Referring to FIG. 6(*a*), a range A is where the positional deviation of the intermediary transfer belt 101 from the normal position of the intermediary transfer belt 101 is no more than 2 mm. The definition that the intermediary transfer belt 101 is within the normal range in terms of the widthwise direction of the intermediary transfer belt 101 means that one of the two edges of the intermediary transfer belt 101 is within the range A. That is, if the lateral shift of the intermediary transfer belt 101 becomes no less than 2 mm, that is, if one of the edges of the intermediary transfer belt 101 moves out of the range A, the control section 201 determines that the automatic belt aligning mechanical device 10 is not working normally. Whether or not one of the edges of the intermediary transfer belt 101 is out of the range A is determined based on the output of the belt position sensor 115. That is, the belt position sensor 115 functions as the means for detecting whether or not the intermediary transfer belt 101 is in the normal range in terms of the widthwise direction of the intermediary transfer belt 101.

Next, referring to FIG. 1, the control section 201 puts the image forming apparatus 100 in the lubrication mode, based on the output of the belt position sensor 115. The lubrication mode is for restoring the automatic belt aligning mechanical device 10 in its capability for preventing the intermediary transfer belt 101 from snaking. In the lubrication mode, a toner image dedicated to lubrication, that is, a band toner image which is not for forming an image on recording medium, is formed on the photosensitive drum 103 of one of the image forming stations 109, and is transferred onto the intermediary transfer belt 101 (this process hereafter will be referred to as "lubricatory toner image formation"). The lubricatory toner image is conveyed to the belt cleaning device 102 by the intermediary transfer belt 101, while the lubricatory toner image is conveyed through the secondary transfer station T2, such DC voltage that is opposite in polarity to the DC voltage applied for image formation is applied to the secondary transfer roller 111, in order to ensure that the lubricatory toner image reaches the belt cleaning device 102 virtually in entirety, while preventing the secondary transfer roller 111 from being soiled by the lubricatory toner image.

There is no restriction regarding the color of the toner of which the lubricatory toner image is formed. In the first embodiment, however, the lubricatory toner image is formed of black toner with the use of the image forming station 109Bk. The lubricatory toner image is formed so that its width matches the entire range of the development area of the developing device in terms of the widthwise direction of the intermediary transfer belt 101. Thus, in terms of the widthwise direction of the intermediary transfer belt 101, the dimension of the lubricatory toner image is roughly the same as that of the cleaning blade 102*b*. The amount of toner per unit area of the lubricatory toner image is 0.5 mg/cm$^2$, and the dimension of the lubricatory toner image in terms of the moving direction of the intermediary transfer belt 101 is 10 mm. When the lubricatory toner image is conveyed through the secondary transfer station T2, −300 V of DC voltage is applied to the secondary transfer roller 111. However, the numerical values given above regarding the formation and conveyance of the lubricatory toner image are not intended to limit the present invention in terms of the specifications of the belt cleaning device 101.

The lubricatory toner image formed through the above described process is conveyed by the intermediary transfer belt 101 to the area of contact between the intermediary transfer belt 101 and cleaning blade 102*b*, and remains in the area of contact. In the area of contact between the intermediary transfer belt 101 and cleaning blade 102*b*, the toner and its external additives function as lubricants, reducing the friction between the intermediary transfer belt 101 and cleaning blade 102*b*. Thus, the automatic belt aligning mechanical device 10 is restored in its function of automatically aligning (centering) the intermediary transfer belt 101 with the utilization of the imbalance in friction between the left and right sides of the belt steering roller 1.

Next, referring to FIG. 8 along with FIG. 7, as the control section 201 receives a job, it starts an image forming operation (S101). Then, it receives signals from the belt position sensor 115, and determines, based on the signals from the sensor 115, whether or not the position of the intermediary transfer belt 101 is laterally offset from the normal position of the intermediary transfer belt 101 by no less than 2 mm (S102).

If the lateral deviation of the intermediary transfer belt 101 is no more than 2 mm (no in S102), the control section 201 does not put the image forming apparatus 100 in the lubrication mode, and makes the image forming apparatus 100 do the job. Then, it determines whether or not the job has been finished (S108). If it determines that the job has been completed (yes in S107), it stops the image forming apparatus 100, but, if the job has not been completed (no in S107), it makes the image forming apparatus 100 start the remaining portion of the job (S101).

If the control section 201 determines that the lateral deviation of the intermediary transfer belt 101 is no less than 2 mm (yes in S102), it finishes the on-going image forming operation (S103), and makes the image forming station 109Bk form a lubricatory toner image, and applies to the secondary transfer roller 111, such DC voltage that is opposite in polarity to the DC voltage to be applied to the secondary transfer roller 111 during the formation of a toner image to be transferred onto recording medium (S104). That is, as it detects that the intermediary transfer belt 101 is outside the normal range in terms of the widthwise direction of the intermediary transfer belt 101, it supplies the intermediary transfer belt 101 with toner as lubricant.

After the delivery of the lubricatory toner image to the intermediary transfer belt 101, the control section 201 circularly moves the intermediary transfer belt 101 several full turns (S105), and determines whether or not the lateral deviation of the intermediary transfer belt 101 has become no more than 2 mm (S106).

If the control section 201 determines that the lateral deviation of the intermediary transfer belt 101 is still no less than 2 mm (no in S106), it forms another lubricatory toner image and delivers the lubricatory toner image to the area of contact between the intermediary transfer belt 101 and cleaning blade 102*b* (S104). Then, it circularly moves the intermediary transfer belt 101 several full turns (S105). If the lateral deviation of the intermediary transfer belt 101 is no more than 2 mm (yes in S106), it determines whether or not the on-going image forming operation has been completed (S107). If it determines that the operation has been completed (yes in S107), it starts working on the remaining portion of the job (S101). If it determines that the job has been completed (yes in S107), it stops the image forming apparatus 100.

In the first embodiment, as the automatic belt aligning mechanical device 10 is made to malfunction by the belt cleaning device 102, a "lubricatory toner image" is formed based on the value of the output of the belt position sensor 115, in order to restore the automatic belt aligning mechanical device 10 in its function of making the intermediary transfer belt 101 and belt steering roller 1 automatically align (center) themselves relative to each other. Further, it is ensured that even when intermediary transfer belt 101 is cleaned by the belt cleaning device 102 which uses the cleaning blade 102*b*, the automatic belt aligning control based on the imbalance in friction between the left and right side of the belt steering roller 1 is continuously and reliably carried out.

Embodiment 2

Figure 9:
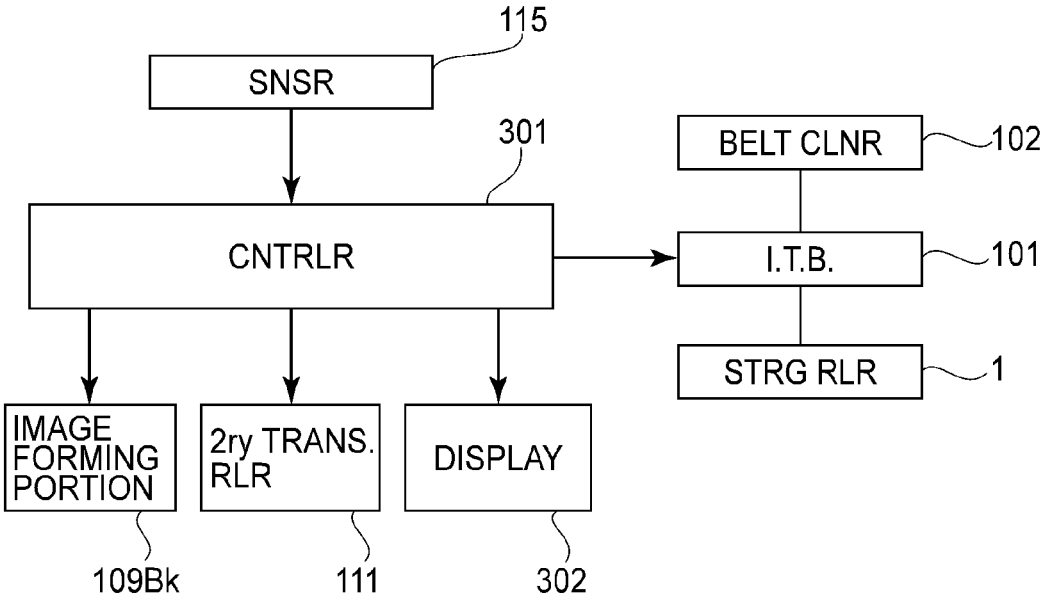
FIG. 9 is a block diagram of the control system, in the second embodiment, which is for operating the image forming apparatus in the lubrication mode.
Figure 10:
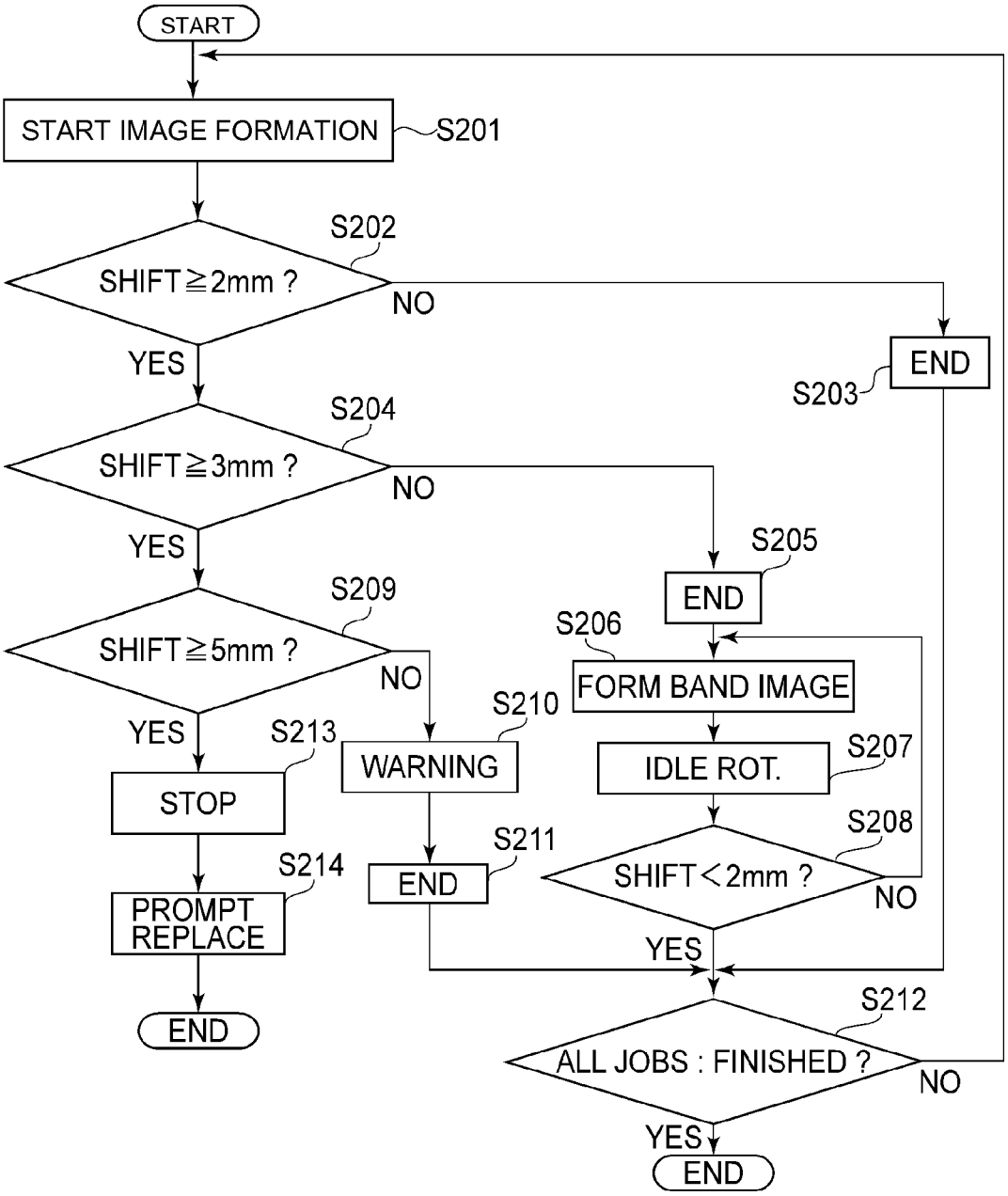
FIG. 10 is a flowchart of the control sequence for the lubrication mode in the second embodiment.

FIG. 9 is a block diagram of the control sequence carried out in the lubrication mode in the second embodiment of the present invention. FIG. 10 is a flowchart of the control sequence carried out in the lubrication mode in the second embodiment. In the lubrication mode in the first embodiment, the lubricatory toner image was formed based on the value of the output of the belt position sensor 115, and was sent to the area of contact between the intermediary transfer belt 101 and cleaning blade 102*b*. However, if the effects of the external disturbance other than the one attributable to the belt cleaning device 102 becomes extremely large, supplying the lubricatory toner image to the area of contact between the intermediary transfer belt 101 and cleaning blade 102*b* sometimes fails to make the intermediary transfer belt 101 return to the normal position. In such a case, the intermediary transfer belt 101 laterally shift beyond recovery.

In the second embodiment, therefore, the following control is carried out. That is, if the lateral deviation of the intermediary transfer belt 101 from the normal position is no less than 2 mm and no more than 3 mm, the same formation and delivery of the lubricatory toner image as those in the first embodiment are done. However, if the lateral deviation of the intermediary transfer belt 101 is no less than 3 mm and no more than 5 mm, the control section 301 makes the control panel of the image forming apparatus 100 display a message that recommends replacing the intermediary transfer belt 101. Further, if the lateral deviation of the intermediary transfer belt 101 is no less 5 mm, the control section 301 stops the image forming apparatus 100 in order to prevent the intermediary transfer belt 101 from breaking, and makes the control panel of the image forming apparatus 100 display a message that demands replacing the intermediary transfer belt 101.

Next, referring to FIG. 10 along with FIG. 9, as the control section 301 receives a job, it starts an image forming operation (S201). Then, it receives signals from the belt position sensor 115, and determines, based on the signals from the sensor 115, whether or not the position of the intermediary transfer belt 101 is laterally offset from the normal position of the intermediary transfer belt 101 by no less than 2 mm (S202).

If the lateral deviation of the intermediary transfer belt 101 is no more than 2 mm (no in S202), the control section 301 does not put the image forming apparatus 100 in the lubrication mode, and makes the image forming apparatus 100 do the job. Then, it determines whether or not the job has been finished (S203). If it determines that the job has been completed (yes in S212), it stops the image forming apparatus 100, but, it determines that the job has not been completed (no in S212), it makes the image forming apparatus 100 start the remaining portion of the job (S201).

If the control section 301 determines that the lateral deviation of the intermediary transfer belt 101 is no less than 2 mm (yes in S202), it determines whether or not the lateral deviation of the intermediary transfer belt 101 is no less than 3 mm. If the lateral deviation of the intermediary transfer belt 101 is no less than 3 mm (yes in S204), it determines whether or not the lateral deviation of the intermediary transfer belt 101 is no less than 5 mm (S209).

If the lateral deviation of the intermediary transfer belt 101 is no less than 2 mm and no more than 3 mm (no in S204), the control section 301 finishes the on-going image forming operation (S205), and begins to operate the image forming apparatus 100 in the lubrication mode (S206). After the completion of the operation in the lubrication mode, the control section 301 circularly moves several full turns (S207), and determines whether or not the lateral deviation of the intermediary transfer belt 101 became no more than 2 mm (S208). If the control section 301 determines that the lateral deviation of the intermediary transfer belt 101 is still no less than 2 mm, it operates the image forming apparatus 100 in the lubrication mode again (S206 and S207). As the lateral deviation of the intermediary transfer belt 101 becomes no more than 2 mm, the control section 301 advances to Step S212.

If the lateral deviation of the intermediary transfer belt 101 is no less than 3 mm and no more than 5 mm (no in S209), the control section 301 shows on the display 302 of the control panel of the image forming apparatus 100, a message that warns a user of the nearness of the end of the service life of the intermediary transfer belt 101 (S210). After the completion of the job (S211), the control section 301 advances to Step S212.

If the lateral deviation of the intermediary transfer belt 101 is no less than 5 mm (yes in S209), the control section 301 stops the image forming apparatus 100 (S213), and shows on the display 302 of the control panel, a message that prompts a user to replace the intermediary transfer belt 101 (S214).

Also in the second embodiment, as the automatic belt aligning mechanical device 10 is made to malfunction by the belt cleaning device 102, a "lubricatory toner image" is formed, based on the value of the output of the belt position sensor 115, and delivered to the area of contact between the intermediary transfer belt 101 and cleaning blade 102*b*, in order to restore the automatic belt aligning mechanical device 10 in its function of making the intermediary transfer belt 101 and belt steering roller 1 automatically align (center) themselves relative to each other. In addition, a message that warms a user of an imminent occurrence of damages to the intermediary transfer belt 101, a message that prompts a user to replace the intermediary transfer belt 101, or the like, is given before it becomes impossible for the intermediary transfer belt 101 to be automatically aligned (centered).

Embodiment 3

Figure 11:
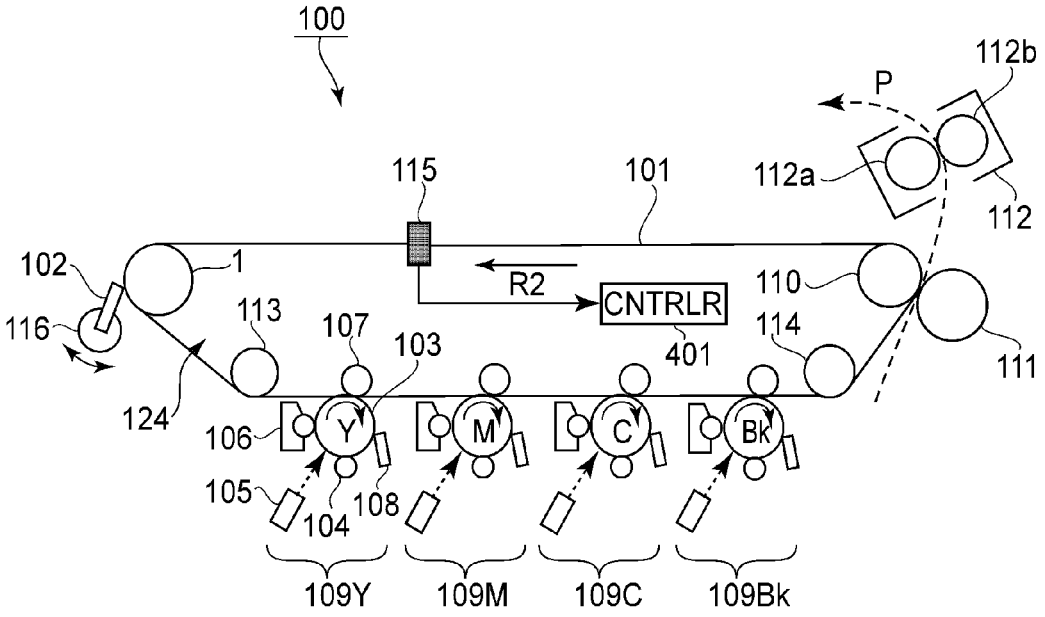
FIG. 11 is a schematic sectional view of the image forming apparatus in the third embodiment of the present invention, and shows the general structure of the apparatus.
Figure 12:
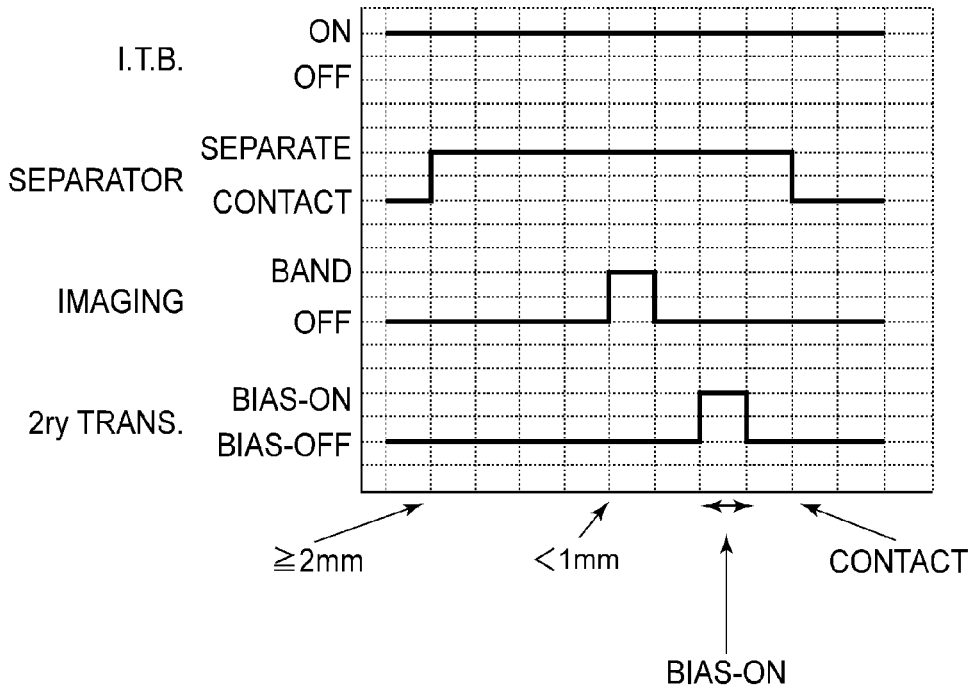
FIG. 12 is a timing chart for the lubrication mode in the third embodiment.
Figure 13:
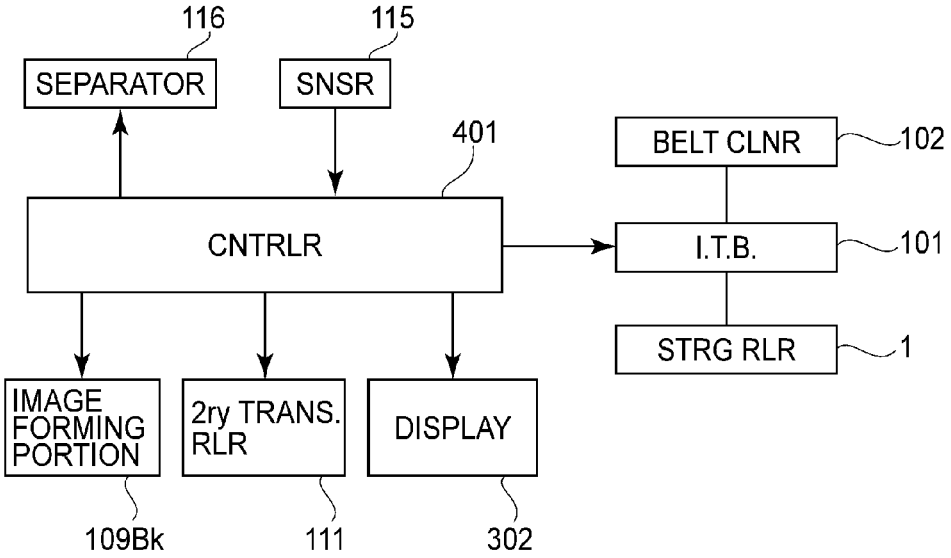
FIG. 13 is a block diagram of the control system, in the third embodiment, which is for operating the image forming apparatus in the lubrication mode.
Figure 14:
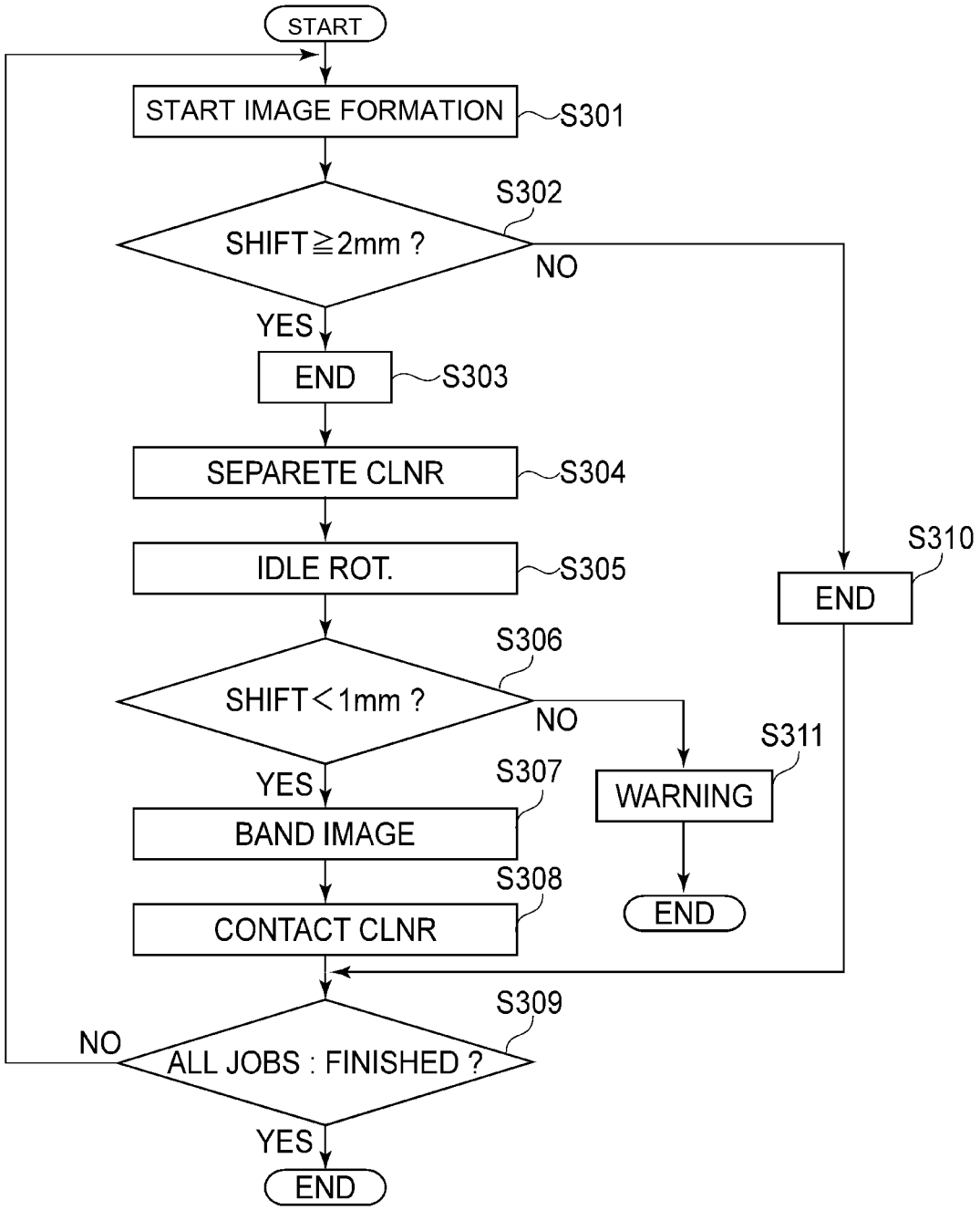
FIG. 14 is a flowchart of the control sequence of the lubrication mode in the third embodiment.

FIG. 11 is a schematic sectional view of the image forming apparatus in the third embodiment of the present invention, and shows the general structure of the apparatus. FIG. 12 is a timing chart of the lubrication mode in the third embodiment. FIG. 13 is a block diagram of the control system for operating the image forming apparatus 100 in the lubrication mode in the third embodiment. FIG. 14 is a flowchart of the lubrication mode in the third embodiment.

The third embodiment is the same as the first embodiment except that in the third embodiment, the cleaning blade 102*b* of the belt cleaning device 102 is separated from the intermediary transfer belt 101 before it is determined whether or not it is necessary to operate the image forming apparatus 100 in the lubrication mode. Further, the image forming apparatus 100 in the third embodiment is the same as that in the first embodiment except that the cleaning blade 102*b* of the belt cleaning device 102 in the third embodiment is separable from the intermediary transfer belt 101. Thus, the structural components in FIGS. 11, 13 and 14, which are the same in function as the counterparts in the first embodiment are given the same referential codes as the counterparts in the first embodiment, respectively, and are not going to be described here in order not to repeat the same descriptions.

Referring to FIG. 11, the image forming apparatus 100 is provided with a separating mechanism 116 which can separate the cleaning blade 102*b* of the cleaning device 102 from the intermediary transfer belt 101 or place the cleaning blade 102*b* in contact with the intermediary transfer belt 101.

The control section 401 determines, based on the value of the output of the belt position sensor 115, whether or not the cleaning blade 102*b* of the cleaning device 102 is to be separated from the intermediary transfer belt 101. More concretely, if the lateral deviation of the intermediary transfer belt 101 from the normal position of the intermediary transfer belt 101 is no less than 2 mm, the control section 401 activates the separating mechanism 116 to separate the cleaning blade 102*b* of the belt cleaning device 102 from the intermediary transfer belt 101. Then, it determines whether or not the intermediary transfer belt 101 reduces in the lateral deviation. If the intermediary transfer belt 101 reduces in the lateral deviation, the control section 401 operates the image forming apparatus 100 in the lubrication mode.

As the cleaning blade 102*b* of the belt cleaning device 102 is separated from the intermediary transfer belt 101, the intermediary transfer belt 101 is freed from the external disturbance attributable to the cleaning device 102. Thus, it becomes possible for the belt aligning mechanism 10 to align the intermediary transfer belt 101 with the use of its belt steering roller 1. There is no restriction regarding the timing for placing the cleaning blade 102*b* of the belt cleaning device 102 in contact with the intermediary transfer belt 101. In the third embodiment, however, in consideration of the length of the downtime of the image forming apparatus 100, the control section 401 places the cleaning blade 102*b* in contact with the intermediary transfer belt 101 as soon as the lateral deviation of the intermediary transfer belt 101 becomes no more than 1 mm.

Incidentally, when the cleaning blade 102*b* of the belt cleaning device 102 is separated from the intermediary transfer belt 101 or placed in contact with the intermediary transfer belt 101, the intermediary transfer belt 101 may be kept circularly moved, or stationary. In the third embodiment, the intermediary transfer belt 101 is kept circularly moved.

The friction between the intermediary transfer belt 101 and the cleaning blade 102*b* of the belt cleaning device 102 is substantial. Therefore, a "lubricatory toner image" is formed and delivered to the nip between the intermediary transfer belt 101 and cleaning blade 102*b* to supply the nip with a combination of toner and external additives, as lubricant. The timing for the formation and delivery of the lubricatory toner image may be after or prior to the placement of the cleaning blade 102*b* in contact with the intermediary transfer belt 101. However, from the standpoint of making as short as possible the length of time the intermediary transfer belt 101 is circularly moved while the friction between the intermediary transfer belt 101 and cleaning blade 102*b* is substantial, it is desired to be immediately before the lubricatory toner image reaches the area of contact between the intermediary transfer belt 101 and cleaning blade 102*b* that the cleaning blade 102*b* is placed in contact with the intermediary transfer belt 101.

The condition under which the lubricatory toner image is formed and delivered in this embodiment is the same as that in the first embodiment. Further, the lubricatory toner image formed in the third embodiment, and the voltage applied to the secondary transfer roller 111 of the secondary transfer station while the image forming apparatus 100 is operated in the lubrication mode, are the same as those in the first embodiment.

Next, referring to FIG. 14 along with FIG. 13, as the control section 401 receives a job, it starts an image forming operation (S301). Then, the control section 401 receives signals from the belt position sensor 115, and determines whether or not the lateral deviation of the intermediary transfer belt 101 is no less than 2 mm (S302).

If the lateral deviation of the intermediary transfer belt 101 is no more than 2 mm (no in S302), the control section 401 continues the image forming operation without putting the image forming apparatus 100 in the lubrication mode (S310). Then, it determines whether or not the job has been completed (S309). If the job has been completed (yes in S309), the control section 401 stops the image forming apparatus 100. If the job has not been completed (no in S309), the control section 401 starts the image forming apparatus 100 to finish the remaining portion of the job (S301).

If the lateral deviation of the intermediary transfer belt 101 is no less than 2 mm (yes in S302), the control section 401 finishes the on-going image forming operation (S303). Then, it separates the cleaning blade 102*b* of the belt cleaning device 102 from the intermediary transfer belt 101 by activating the separating mechanism 116 (S304), and lets the intermediary transfer belt 101 idle (S305). Then, it determines whether or not the lateral deviation of the intermediary transfer belt 101 is no more than 1 mm, while letting the intermediary transfer belt 101 idle (S306).

If the lateral deviation of the intermediary transfer belt 101 or the amplitude (lateral deviation) of the snaking of the intermediary transfer belt 101 is no less than 1 mm after the idling of the intermediary transfer belt 101 one minute (no in S306), the control section 401 determines that even if the image forming apparatus 100 is operated in the lubrication mode, the automatic belt aligning mechanical device cannot be restored in its function of automatically controlling the intermediary transfer belt 101 in lateral shift. Thus, the control section 401 shows on the display 302 of the control panel, a message that informs a user that the intermediary transfer belt 101 needs to be examined (S311), and stops the image forming apparatus 100.

Referring to FIG. 12, if the amplitude (lateral deviation) of the pattern of snaking of the intermediary transfer belt 101 becomes no more than 1 mm while the intermediary transfer belt 101 is idled (yes in S306), the control section 401 begins to operate the image forming apparatus 100 in the lubrication mode. Then, if the lateral deviation of the intermediary transfer belt 101 becomes no more than 1 mm, the control section 401 forms a lubricatory toner image in the image forming station 109Bk, and applies to the secondary transfer roller 111, such DC voltage that is opposite in polarity to that applied while a toner image is formed to transferred onto recording medium (S307). It places the cleaning blade 102*b* of the belt cleaning device 102 in contact with the intermediary transfer belt 101 by activating the separating mechanism 116, before the lubricatory toner image reaches the area of contact between the cleaning blade 102*b* and intermediary transfer belt 101 (S308).

After the image forming apparatus 100 is operated in the lubrication mode, the control section 401 determines whether or not the job has been completed. If the job has been completed (yes in S309), the control section 401 stops the image forming apparatus 100. If the job has not been completed (no in S309), the control section 401 starts the image forming apparatus 100 to finish the remaining portion of the job (S301).

In the lubrication mode in the third embodiment, in order to determine whether or not the image forming apparatus 100 is to be operated in the lubrication mode, the control section 401 separates the cleaning blade 102*b* of the belt cleaning device 102 from the intermediary transfer belt 101 before it starts operating the image forming apparatus 100 in the lubrication mode. Therefore, it does not occur that the image forming apparatus 100 is unnecessarily operated in the lubrication mode when the intermediary transfer belt 101 is being made to laterally shift by a source other than the belt cleaning device 102.

Embodiment 4

Figure 17:
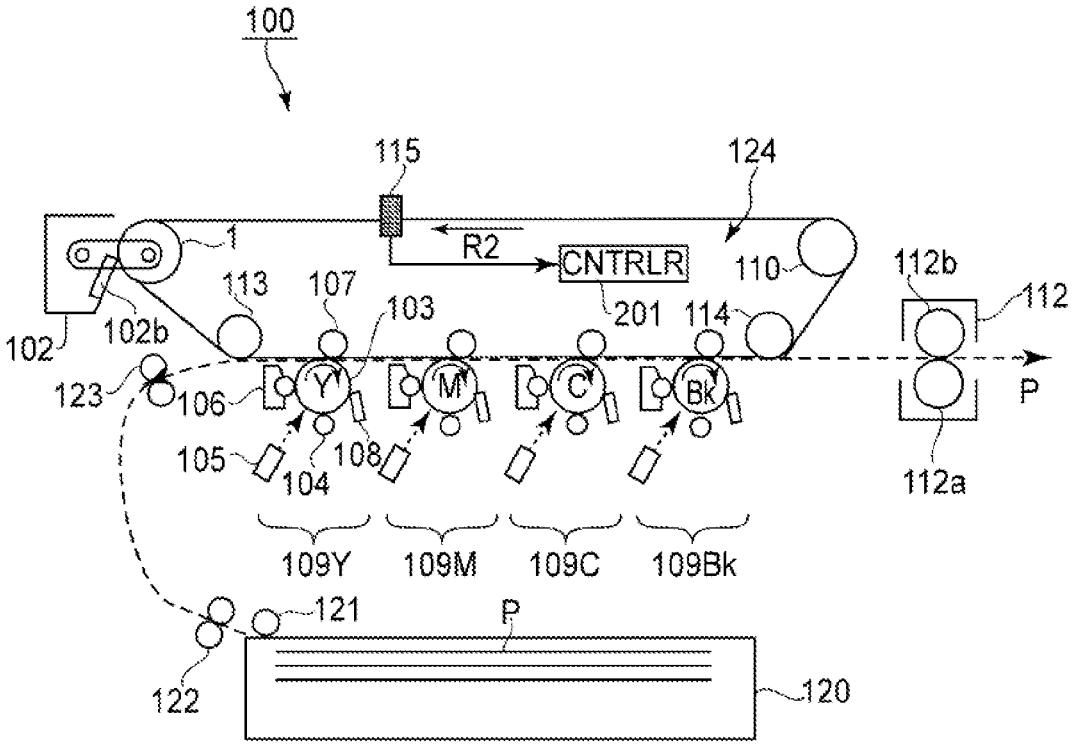
FIG. 17 is a schematic sectional view of an image forming apparatus which steers its recording medium conveyance belt, and shows the general structure of the apparatus.

In the first, second and third embodiments of the present invention, the image forming apparatus was structured so that the intermediary transfer belt 101 is steered by the belt steering roller 1. However, the present invention is also applicable to an image forming apparatus structured so that a recording medium conveyance belt 201 for conveying a sheet of recording medium, onto which a toner image is transferred, is steered by the belt steering roller 1 (FIG. 17).

Further, the present invention is also applicable to an image forming apparatus structured so that a member other than the cleaning blade is placed in contact with an intermediary transfer belt or a recording medium conveyance belt. That is, the present invention is applicable to an image forming apparatus even if the apparatus is structured so that a polishing roller, a fur brush, a charge brush, a magnetic roller, a cleaning web, or the like, that is, a cleaning means other than the cleaning blade is placed in contact with an intermediary transfer belt or a recording medium conveyance belt. The lubricant may be powdery lubricant other than toner, or liquid lubricant.

<Detailed Description of Automatic Control of Lateral Shift of Intermediary Transfer Belt>

Figure 15:
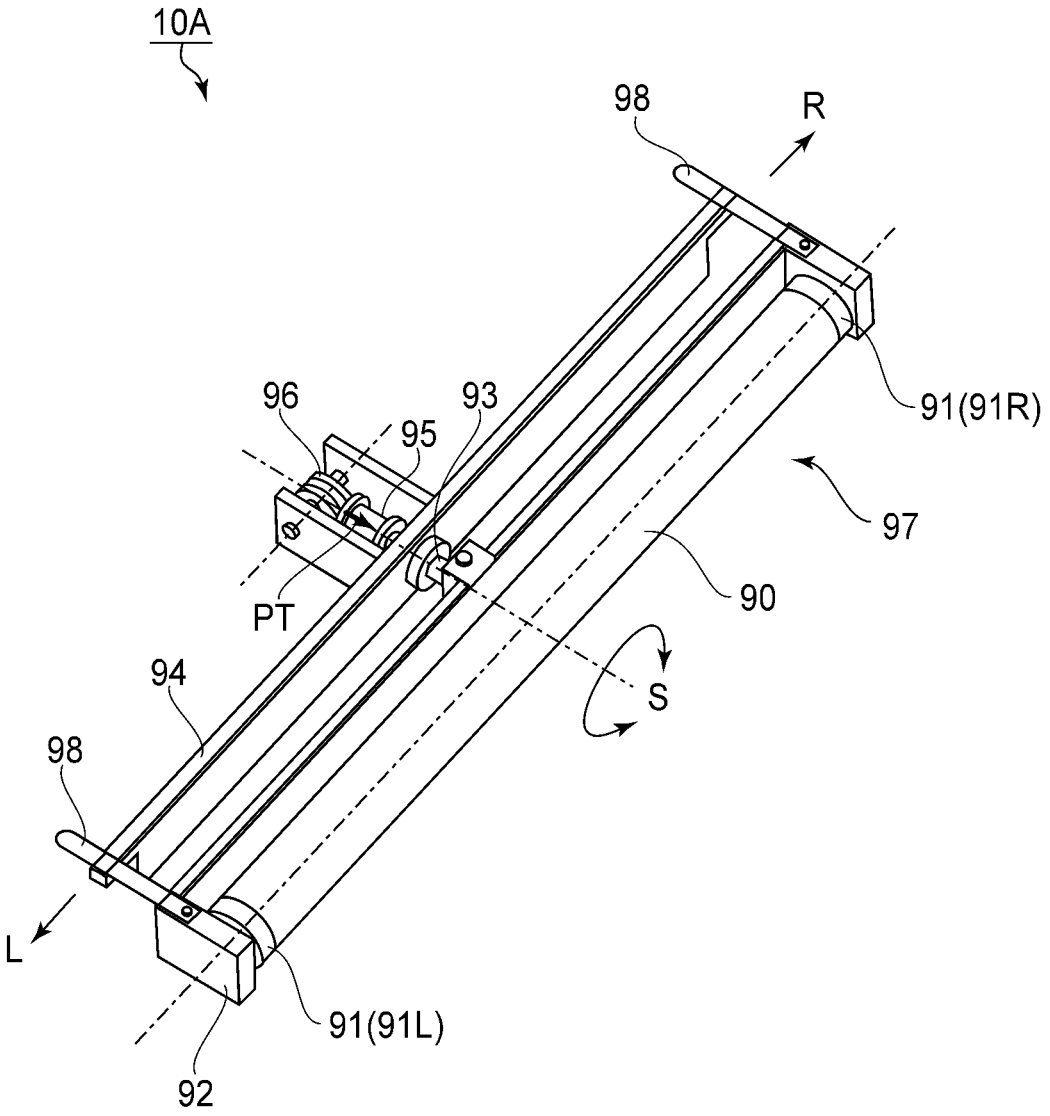
FIG. 15 is a perspective view of the automatic belt aligning mechanism in the first, second, and third embodiments, and shows the general structure of the mechanism.
Figure 16:
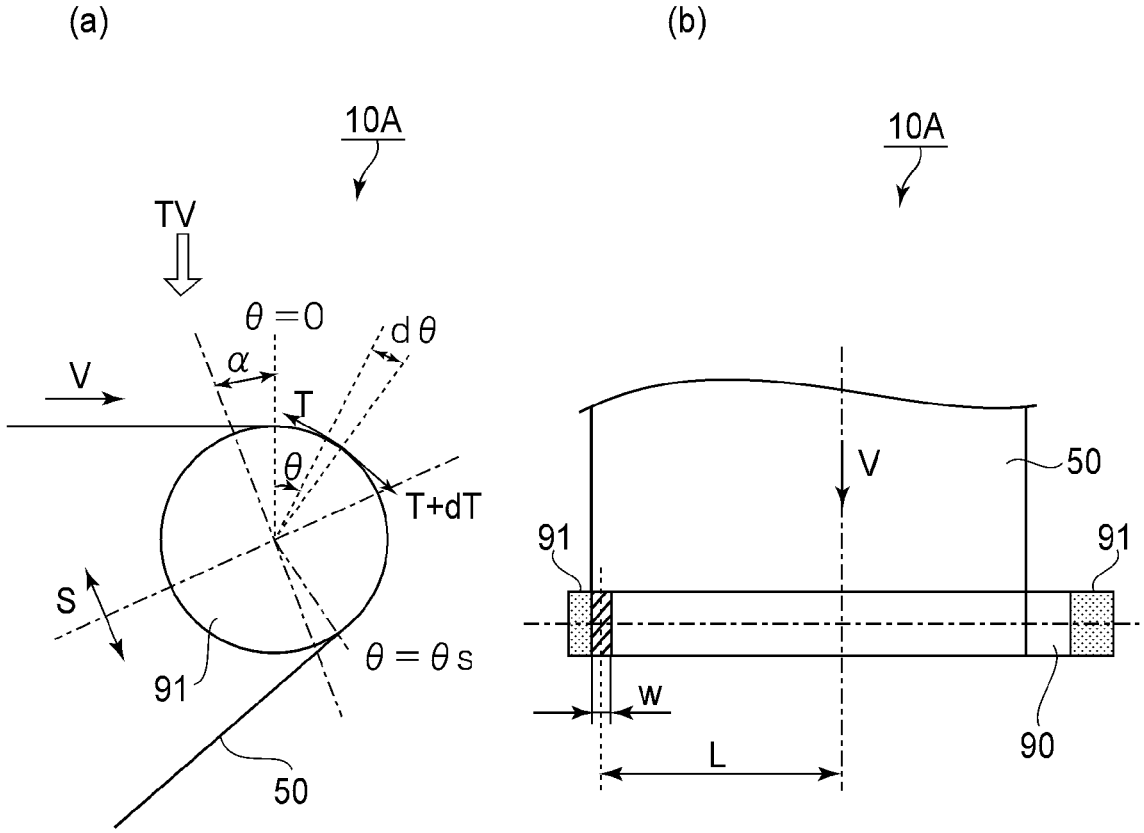
FIG. 16 is a drawing for describing the amount by which the belt wraps around the belt steering member, and the state in which the belt wraps around the belt steering roller.

FIG. 15 is a perspective view of the automatic belt aligning mechanism. It is for describing the structure of the mechanism. FIG. 16 is a drawing for describing the state in which an endless belt wraps around a belt steering roller. FIG. 16(*b*) is a plan view of the combination of the endless belt and belt steering roller, as seen from the direction indicated by an arrow mark TV in FIG. 16(*a*).

The qualitative description of the operation of the belt training mechanism is the same as the one given above with reference to FIG. 2. Here, therefore, the automatic aligning (centering) of an endless belt by the belt steering roller of an automatic belt aligning mechanism is quantitatively described.

Referring to FIG. 15, an automatic belt aligning mechanical device 10A has a steering roller 97 made up of a center section 90 and a pair of lengthwise end sections 91. The center section 90 is rotatable by the circular movement of an endless belt (50 in FIG. 16), but, the lengthwise end sections 91 cannot be rotated by the circular movement of the endless belt. The steering roller 97 is supported by a steering roller supporting member 92, which is rotatable in an oscillatory manner in the direction indicated by an arrow mark S, about the axial line of the steering shaft 93 attached to the center of the steering roller supporting member in terms of the lengthwise direction of the steering roller supporting member 92. The steering roller supporting member 92 is kept pressured in the direction indicated by an arrow mark PT by a pressure applying member 95 which is compressed or released by a cam 96. Thus, the steering roller 97 keeps the endless belt (50 in FIG. 16) tensioned.

Next, referring to FIG. 16(*a*), the lengthwise end sections 91 of the steering roller 97 are supported in such a manner that they cannot be rotated by the movement of the endless belt 50. Therefore, as the belt 50 is circularly moved, the lengthwise end sections 19 are continuously subjected to the friction from the inward surface of the endless belt 50. It is assumed here that the endless belt 50 is being circularly moved in the direction indicated by an arrow mark V, and the angle of contact between the endless belt 50 and each of the lengthwise end sections 91 is θs. The width of contact (in terms of direction perpendicular to FIG. 16) between the endless belt 50 and the lengthwise end section 91 is a preset unit width.

To think of the portion of the endless belt 50, which corresponds to an infinitesimal angle dθ of contact between the endless belt 50 and the lengthwise end section 91 of the steering roller 97, the upstream side of the portion of the endless belt 50, which corresponds to the infinitesimal angle dθ, in terms of the moving direction of the endless belt 50, is not being pulled by the belt driving roller, and the downstream side of the above described portion of the endless belt 50 is being pulled by the belt driving roller. Therefore, if the amount of tensile force which acts on the upstream end of the above described portion of the endless belt 50, in the direction parallel to the tangential line to the upstream end is T, the amount of tensile force which acts on the downstream end of the above described portion of the endless belt 50, in the direction parallel to the tangential line to the downstream end is T+dT. Thus, the amount of force which the endless belt 50 applies to each of the lengthwise end sections 91 of the steering roller 97, toward the axial line of the lengthwise end section 91 may be approximated as Tdθ. Thus, if the coefficient of friction of the lengthwise end section 91 is μS, the amount dF of friction between the lengthwise section 91 and endless belt 50 can be expressed in the form of the following mathematical equation:

$$dF=\mu sTd\theta \tag{1}$$

The tensile force T is attributable to the unshown belt driving roller. Therefore, if the coefficient of friction of the belt driving roller is μr, the tensile force dT can be expressed in the form of the following mathematical equation:

$$dT=\mu rTd\theta \tag{2}$$

Modifying Equation (2), $$\frac{dT}{T}=-\mu_r d\theta \tag{2'}$$

The amount of the tensile force T can be obtained from the following equation obtained by integrating Formula (2') with respect to angle θS of contact:

$$T=T_1e^{-\mu r\theta} \tag{3}$$

T1 is the amount of the tensile force where θ=0. Combining Equations (1) and (3), $$dF=\mu_sT_1e^{-\mu_r\theta}d\theta \tag{4}$$

Referring to FIG. 15, when the direction in which the steering roller supporting member 92 rotationally moves about the steering shaft 93 is the one indicated by an arrow mark S, there is an angle α between the rotational direction S and the plane which coincides with the point at which the intermediary transfer belt 101 begins to wrap around the steering roller 97, and the axial line of the steering roller 97. Therefore, the amount of the downward component of the force calculable with the use of Equation (4) can be calculated with the use of the following equation:

$$dF_s=\mu_sT_1e^{-\mu_r\theta}\sin(\theta+\alpha)d\theta \tag{5}$$

Further, the amount (per unit width) of downward force, which is parallel to the direction indicated by the arrow mark S, and which each of the lengthwise end sections 91 receives from the endless belt 50, can be obtained by integrating Equation (5) with respect to angle θS of contact.

$$F_s = \mu_s T_1 \int_0^{\theta_3} e^{-\mu_r \theta} \sin(\theta + \alpha)\, d\theta \tag{6}$$

Referring to FIG. 16(*b*), it is assumed here that the endless belt 50 has shifted leftward of the FIG. 16(*b*) while the endless belt 50 is circularly moved in the direction indicated by an arrow mark V, and also, that the left edge portion of the endless belt 50 is in contact with the corresponding lengthwise end section 91 of the steering roller 97, by a width of w, whereas the right edge portion of the endless belt 50 is not in contact with the corresponding lengthwise end section 91 of the steering roller 97. Thus, the left lengthwise end section 91 of the steering roller 97 is under an amount Fsw of force directed downward in terms of the direction indicated by the arrow mark S, whereas the lengthwise right end section 91 of the steering roller 97 is under zero amount of force directed downward in terms of the direction indicated by the arrow mark S. Thus, the difference in the amount of friction between the left and right end sections of the steering roller 97 is the primary source that generates moment FswL, that is, the force which causes the steering roller 97 to rotationally move about the steering shaft (93 in FIG. 15). The moment which acts in the direction to rotationally move the steering roller 97 about the steering shaft (93 in FIG. 15) is called "steering torque". In the case of the assumption made as described in FIG. 16(*b*), the direction of the steering toque is such that makes the left side of the steering roller 97, that is, the side to which the endless belt 50 has shifted, moves downward.

The direction in which moment is generated in the steering roller 97 based on the above described principle coincides with the direction in which the steering roller 97 is to be rotationally moved to cause the endless belt 50 to shift in the opposite direction from the direction in which the belt 50 has just shifted. Therefore, the lateral shift of the endless belt 50 caused by external disturbance is cancelled. That is, the endless belt 50 is automatically aligned.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 152830/2011 filed Jul. 11, 2011 which is hereby incorporated by reference.

What is claimed is:

1. An image forming apparatus comprising:

a rotatable endless belt;

an image forming unit configured to form a toner image on said endless belt;

a stretching member configured to stretch said endless belt;

an inclining device configured to incline said endless belt so as to keep said endless belt in a normal range in a widthwise direction of said endless belt, said inclining device including a rotatable portion rotatable with rotation of said endless belt, a non-rotatable portion, provided at opposite end portions of said rotatable portion with respect to the widthwise direction of said endless belt, to be rubbed by said endless belt, a supporting member configured to support said rotatable portion and said non-rotatable portion, and a rotational shaft configured to rotatably support said supporting member, wherein said supporting member is rotatable by force produced by the rubbing between said endless belt and said non-rotatable portion to move said endless belt in the widthwise direction;

a blade member, provided opposed to said rotatable portion of said inclining device through said endless belt, configured to press against said endless belt at a pressing portion to clean said endless belt;

a roller member contacted to an outer periphery of said endless belt at a position downstream of said image forming unit and upstream of said blade member with respect to a direction in which said endless belt moves;

a voltage applying member configured to apply a voltage to said roller member;

a detecting portion configured to detect a position of said endless belt in the widthwise direction; and an executing portion configured to execute a mode in which a toner band is supplied to the pressing portion throughout a range of a whole width of said blade member, when said detecting portion detects that said endless belt has deviated from the normal range in the widthwise direction, wherein a voltage of the same polarity as a charge polarity of the toner is applied to said roller member by said voltage applying member, when the toner band passes by said roller member.

2. An apparatus according to claim 1, wherein said non-rotatable portion has a diameter increasing toward an outside thereof.

3. An apparatus according to claim 1, further comprising a rotary damper configured to provide a viscous resistance against rotation of said supporting member.

4. An apparatus according to claim 1, further comprising a spacing mechanism configured to contact and space said blade member relative to said endless belt, wherein said spacing mechanism spaces said blade member from said endless belt before supply of the toner band in said mode.

5. An image forming apparatus comprising:

a rotatable endless belt;

an image forming unit configured to form a toner image on a recording material fed to said endless belt;

a stretching member configured to stretch said endless belt;

an inclining device configured to incline said endless belt so as to keep said endless belt in a normal range in a widthwise direction of said endless belt, said inclining device including a rotatable portion rotatable with rotation of said endless belt, a non-rotatable portion, provided at opposite end portions of said rotatable portion with respect to the widthwise direction of said endless belt, to be rubbed by said endless belt, a supporting member configured to support said rotatable portion and said non-rotatable portion, and a rotational shaft configured to rotatably support said supporting member, wherein said supporting member is rotatable by force produced by the rubbing between said endless belt and said non-rotatable portion to move said endless belt in the widthwise direction;

a blade member, provided opposed to said rotatable portion of said inclining device through said endless belt, configured to press against said endless belt at a pressing portion to clean said endless belt;

a roller member contacted to an outer periphery of said endless belt at a position downstream of said image forming unit and upstream of said blade member with respect to a direction in which said endless belt moves;

a voltage applying member configured to apply a voltage to said roller member;

a detecting portion configured to detect a position of said endless belt in the widthwise direction; and an executing portion configured to execute a mode in which a toner band is supplied to the pressing portion throughout a range of a whole width of said blade member, when said detecting portion detects that said endless belt has deviated from the normal range in the widthwise direction, wherein a voltage of the same polarity as a charge polarity of the toner is applied to said roller member by said voltage applying member, when the toner band passes by said roller member.

6. An apparatus according to claim 5, wherein said non-rotatable portion has a diameter increasing toward an outside thereof.

7. An apparatus according to claim 5, further comprising a rotary damper configured to provide a viscous resistance against rotation of said supporting member.

8. An apparatus according to claim 5, further comprising a spacing mechanism configured to contact and space said blade member relative to said endless belt, wherein said spacing mechanism spaces said blade member from said endless belt before supply of the toner band in said mode.

* * * * *